US008171847B2

(12) United States Patent
Herbert

(10) Patent No.: US 8,171,847 B2
(45) Date of Patent: May 8, 2012

(54) PRINTING PRESS INCLUDING FOLD FORMERS OF DIFFERENT WIDTHS AND AT LEAST ONE FOLD FORMER THAT IS MOVABLE IN A DIRECTION TRANSVERSE TO WEB TRAVEL

(75) Inventor: Burkard Otto Herbert, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/998,528

(22) PCT Filed: Oct. 15, 2009

(86) PCT No.: PCT/EP2009/063462

§ 371 (c)(1),
(2), (4) Date: Apr. 29, 2011

(87) PCT Pub. No.: WO2010/049278

PCT Pub. Date: May 6, 2010

(65) Prior Publication Data

US 2011/0209638 A1 Sep. 1, 2011

(30) Foreign Application Priority Data

Oct. 31, 2008 (DE) ..... 10 2008 043 376
Feb. 19, 2009 (DE) ..... 10 2009 001 011

(51) Int. Cl.
*B41F 13/02* (2006.01)
*B41F 13/06* (2006.01)

(52) U.S. Cl. ..... 101/228; 101/231; 270/5.01; 270/41

(58) Field of Classification Search ..... 101/226, 101/227, 228, 231; 270/5.01, 21.1, 41
See application file for complete search history.

(56) References Cited

U.S. PATENT DOCUMENTS

| | | | | |
|---|---|---|---|---|
| 4,925,170 | A | 5/1990 | Weis | |
| 5,328,437 | A * | 7/1994 | Maylander et al. | 493/357 |
| 5,503,379 | A * | 4/1996 | Michalik et al. | 270/5.01 |
| 7,182,020 | B2 | 2/2007 | Herbert | |
| 7,275,709 | B2 | 10/2007 | Weis | |
| 2005/0172841 | A1 | 8/2005 | Goto | |
| 2008/0116625 | A1 * | 5/2008 | Stein et al. | 270/41 |

(Continued)

FOREIGN PATENT DOCUMENTS

DE 38 11 909 A1 6/1989

(Continued)

*Primary Examiner* — Leslie J Evanisko
(74) *Attorney, Agent, or Firm* — Mattingly & Malur, PC

(57) ABSTRACT

A superstructure of a printing press includes a turning tower with at least one turner bar that is usable to deflect a web section from a transport direction by 90°. A second turner bar, that is shorter than the first turner bar, is also used to deflect a web section from the transport direction by 90° in the same direction as the first web section. These first and second turner bars are offset vertically in relation to one another in the same turning tower. The first turner bar is supported at both ends on at least one first lateral support and at least one second lateral support. The second turner bar is supported only on one end on the lateral support in a floating manner. The second support side of the second turner bar is provided with access from that support side into the interior of the turning tower.

15 Claims, 25 Drawing Sheets

U.S. PATENT DOCUMENTS

| | | | |
|---|---|---|---|
| 2009/0031906 | A1 | 2/2009 | Eckert |
| 2009/0031907 | A1 | 2/2009 | Eckert et al. |

FOREIGN PATENT DOCUMENTS

| | | | |
|---|---|---|---|
| DE | 44 19 217 | A1 | 12/1995 |
| DE | 100 22 964 | A1 | 10/2001 |
| DE | 101 31 272 | B4 | 1/2003 |
| DE | 103 11 636 | A1 | 11/2004 |
| DE | 102 35 391 | A1 | 12/2004 |
| EP | 1 477 311 | A1 | 11/2004 |
| WO | 2006111522 | A1 | 10/2006 |
| WO | 2007020285 | A1 | 2/2007 |
| WO | 2007068643 | A1 | 6/2007 |

* cited by examiner

PRINTING PRESS INCLUDING FOLD FORMERS OF DIFFERENT WIDTHS AND AT LEAST ONE FOLD FORMER THAT IS MOVABLE IN A DIRECTION TRANSVERSE TO WEB TRAVEL

CROSS-REFERENCE TO RELATED APPLICATIONS

This application is the U.S. national phase, under 35 U.S.C. 371, of PCT/EP2009/063462, filed Oct. 15, 2009; published as WO 2010/049278 A2 and A3 on May 6, 2010; and claiming priority to DE 10 2008 043 376.4, filed Oct. 31, 2008, and to DE 10 2009 001 011.4, filed Feb. 19, 2009, the disclosures of which are expressly incorporated herein by reference.

FIELD OF THE INVENTION

The invention relates to a superstructure of a printing press and a printing press, and methods for using a printing press. A superstructure of a printing press includes a turning tower with at least one first turning bar which can be used to deflect a web ribbon 90°, in its direction of web transport. At least one second turning bar, which is shorter than the first turning bar, is also located in the turning tower. The second turning bar can be used to deflect a web ribbon 90° in its direction of web transport, to the same direction as the first web ribbon. The printing press also includes at least one printing unit that is in a common machine alignment with the turning tower. The turning tower can deflect the web 90° out of that machine alignment to a former structure which is aligned with the turning tower and whose direction of travel of the web entering it from the turning tower is 90° from the machine alignment. The former structure has at least one former plane with at least two fold formers arranged side by side.

BACKGROUND OF THE INVENTION

WO 2006/111522 A1 describes a printing press wherein a former structure is arranged rotated 90° in relation to the longitudinal axis of the machine, and wherein at least one turning bar is provided, the width of which is sufficient for turning a full, uncut web.

WO 2007/020285 A1 discloses a printing press comprising two different printing press lines or printing couples, wherein mixed production can be generated from differently imprinted webs, simultaneously.

WO 2007/068643 A1 discloses a printing press system comprising a plurality of parallel machine lines, wherein one line is embodied as having triple-width printing units for newspaper printing and produces via a turning tower having turning bars that are four pages in width, on a former structure which is only double width and is arranged at an angle in relation to the machine line. In a double-width heatset line, which is arranged in parallel, dried heatset webs that are four pages in width can also be fed to the former structure.

DE 101 31 272 B4 discloses a cantilevered and swivel-mounted turning bar.

DE 38 11 909 A1 discloses a printing press with a superstructure, wherein partial webs are successively offset laterally in relation to the machine alignment, over two turning bars having the width of a partial web. One of the two turning bars can be cantilevered and the other mounted at both ends.

DE 102 35 391 A1 discloses a triple-width newspaper printing press, wherein the alignment of cut partial webs can be offset by the use of pairs of turning bars having the width of a partial web.

DE 44 19 217 A1 discloses a superstructure of a printing press comprising a turning tower having a plurality of pairs of turning bars and a fold former, downstream of which a shorter, cantilevered folding roller and a longer folding roller, mounted at both ends, are positioned.

DE 100 22 964 A1 discloses a superstructure of a printing press comprising a turning tower having a plurality of pairs of turning bars and a fold former, downstream of which a shorter, cantilevered folding roller and a longer folding roller, mounted at both ends, are positioned.

DE 103 11 636 A1 discloses a turning tower between two printing units, wherein the turning tower comprises a plurality of turning bars, one above the other.

DE 44 19 217 A1 discloses a double-former folding unit. Above a folding unit, one larger fold former for processing the full web width is provided, and below this, one smaller fold former for processing one-half the web width is also provided.

EP 1 477 311 A1 discloses a printing press having a plurality of printing units arranged in one machine line. A former structure comprising two stationary fold formers is arranged at an angle in relation to the machine line. A turning bar deck has a turning bar extending over the entire web width, and two movable, half-width turning bars.

SUMMARY OF THE INVENTION

The problem addressed by the invention is that of devising a superstructure for a variable printing press, a variable printing press, and methods for using a printing press.

The problem is solved according to the invention by the positioning of the first and second turning bars in the same turning tower and offset vertically. The first turning bar is at least supported at both ends on a first and a second side frame. The second turning bar is mounted at only one end, in a cantilevered manner, on the first side frame. The second turning bar is provided with access, in this frame side, into the interior of the turning tower. The usable widths of the at least two fold formers, which are arranged side by side in the same former plane, are different from one another. At least one of the at least two fold formers is movable transversely to the direction of web travel through the former.

The benefits to be achieved by the invention consist particularly in that a stable but operable superstructure and a corresponding printing press for variable production are devised.

These can be used to produce different types of products, such as semi-commercial products (newspaper inserts, advertisements, etc., for example, produced in heatset with drying) and newspaper products (e.g., without drying) or mixed products (newspaper products supplemented with heatset pages).

To achieve a particular advantage, in terms of variability, it is provided that wide partial webs, more particularly, partial webs of variable width, as is particularly advantageous in heatset applications, can be deflected using long turning bars.

Even with optionally wide partial webs, the turning tower can be operated through an advantageous through opening.

BRIEF DESCRIPTION OF THE DRAWINGS

Embodiment examples of the invention are illustrated in the set of drawings and will be specified in greater detail in what follows.

The drawings show.

DESCRIPTION OF THE PREFERRED EMBODIMENTS

Figure 1:
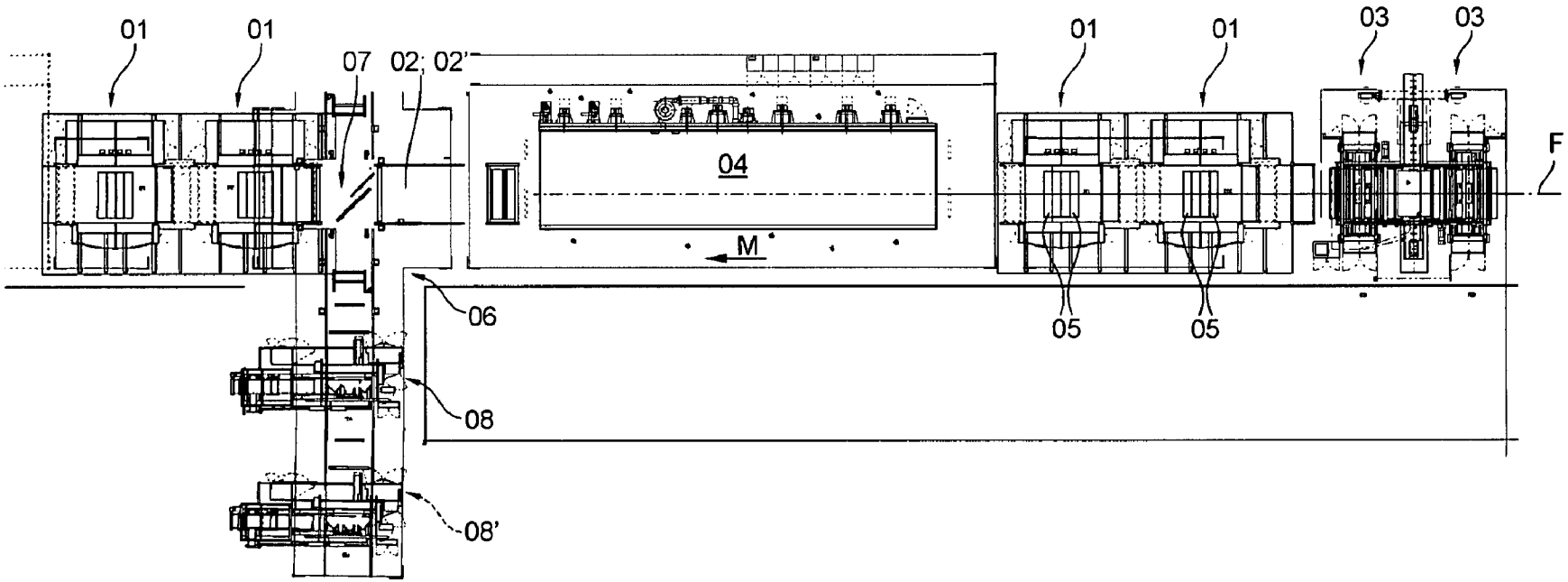
FIG. 1 a plan view of an embodiment example of a printing press.

FIG. 1 shows a plan view of one embodiment example of a printing press, more particularly, a web-fed rotary printing press, comprising at least one first printing unit 01, advantageously a first group of first printing units 01 (in this case, e.g., two) arranged adjacent to one another in a first alignment F, particularly machine alignment F, which is perpendicular to the axial direction of the printing couple cylinders. The printing unit 01 receives a web 02; 02' that is to be imprinted from a reel changer 03 arranged upstream in the web path. At least one dryer 04, for example, a thermal dryer 04, more particularly, a hot air dryer 04, or a radiant-heat dryer embodied as a UV or IR dryer, is provided in the same alignment F, through which dryer at least one web 02; 02' imprinted by a first printing unit 01 can be guided and dried as needed. In what follows, the prefix "heatset"—unless expressly referred to thermal drying—will be used to refer generally to operation using a drying accessory (dryer 04), i.e., using a radiant-heat dryer, such as a UV dryer or IR dryer, for example, or a hot air dryer.

The at least one printing unit 01 of the first group is preferably embodied as a printing tower 01 with a substantially vertical web path, and has a plurality of print positions, one above the other, for two-sided multicolor printing. In principle, the printing tower 01 can be comprised of a plurality of stacked units—for example, H-type printing units or satellite printing units. However, it is advantageous for a plurality of blanket-to-blanket printing units (flat bridge-, n- or u-type units) to be arranged one above the other. The blanket-to-blanket printing units have two printing couples, each with one printing couple cylinder embodied as forme cylinder and one embodied as transfer cylinder, wherein the print position which interacts with a web 02; 02' to be imprinted is formed between the transfer cylinders. In the present example, four—preferably planar—blanket-to-blanket printing couples are arranged one above the other in a shared side frame. The four printing couple cylinders are preferably arranged such that in the print-on position, the rotational axes thereof lie substantially within a shared plane. This plane is preferably inclined 85° to 70° from vertical.

At least one of the first printing units 01 is embodied for operation using inks that are suitable for heatset operation (heatset inks or UV inks) and/or using closed-pored (and/or coated) print substrates. In heatset operation, a web 02' (heatset web 02'), supported by and unwound from the reel changer 03, is imprinted in the (relevant) printing unit 01 using inks that are suitable for heatset operation, and is then dried by an activated dryer 04. The web 02' imprinted in heatset operation is embodied, for example, as glazed and/or heavily coated paper having a coat weight of more than 10 g/m$^2$, for example, more than 15 or even more than 20 g/m$^2$. The paper can be of average or higher quality, with a base weight range of greater than 40 g/m$^2$, for example, in a base weight range of 55-90 g/m$^2$, particularly greater than 50 g/m$^2$. The Bekk smoothness factor, at least on the smoother side, is preferably at least 70.0 sec, more particularly, at least 100.0 sec.

Preferably, at least one of the printing units 01 of the first group is embodied for heatset operation (using correspondingly suitable ink and/or higher quality print substrate), and at least one of the printing units 01 is embodied for coldset operation, i.e., using inks suitable for coldset, and for imprinting the web 02 without passing it through a drying process.

In coldset operation, the relevant printing unit 01 is loaded with a coldset web 02, for example, with "normal" or improved newsprint paper, i.e., the web 02 is uncoated or lightly coated paper having a maximum coat weight of 20 g/m$^2$, for example, a maximum of 10 g/m$^2$, more particularly, a maximum of 5 g/m$^2$, supported by and unwound from the reel changer 03. Rather than uncoated or lightly coated paper, in "coldset" operation, paper referred to as "improved newsprint paper" can be used as the web of print substrate. In the coldset method, the paper has a maximum base weight, for example, of 65 g/m$^2$, and for uncoated newsprint paper, for example, a maximum of 50 g/m$^2$ or even a maximum of 40 g/m$^2$. In "coldset" operation, a web 02 or a paper that has a Parker Print Surf (PPS) roughness of greater than 3.50 μm, more particularly, greater than 4.00 μm, is preferably used.

However, the printing units 01 of the first group can also all be embodied for alternatively coldset operation without subsequent drying, or heatset operation, with subsequent drying (in either case using suitable inks and/or print substrates).

In one advantageous variant, at least one of the printing units 01 can be embodied as a printing unit 01 for dry offset operation. The printing unit(s) 01 for dry offset operation is (or are) then embodied such that it (they) can be or is (are) operated without the addition of dampening agent. The printing couples of such a printing unit 01 are embodied without a dampening unit, and have, for example, inking units, which in an advantageous embodiment are embodied as so-called short ink train units, comprising a screen roller, among other elements. In one particularly advantageous further development, this at least one printing unit 01, which can be operated as a printing unit 01 for dry offset operation, can be operated both in coldset mode and in heatset mode using the same ink, i.e., without changing the ink.

The printing units 01 of the group, at least of at least one of the printing units 01, is preferably embodied as having a width ("triple-width") corresponding to six printed pages, particularly newspaper pages in broadsheet format, arranged side by side, and/or can be loaded with one printing forme or a plurality of printing formes side by side, which have a total of six print images of one newspaper page of a first format, side by side. Preferably, the forme cylinders 05 indicated in FIGS. 1 and 18 of at least one of the printing units 01, advantageously of all the printing units 01 of a group, are embodied to accommodate a printing forme that is continuous over the entire usable cylinder length in the axial direction. Advantageously, they can be embodied to accommodate alternatively one printing forme that is continuous over the usable cylinder length (semi-commercial production) or a plurality of printing formes side by side in the axial direction (e.g., two that are three pages in width and/or three that are two pages in width and/or six that are one page in width), depending on the mode of operation in retail or semi-commercial (e.g., inserts) or newspaper production. For this purpose, the body of such forme cylinders is equipped with at least one groove opening, which is continuous over the effective cylinder length, i.e., the length that is usable for printing, and is configured for holding bent plate ends (FIG. 19). The forme cylinders 05 can also have two grooves of this type, one in front of the other, in which case, in one operating situation, for example, two printing formes, for example, printing formes which extend substantially over the entire width, and optionally in another operating situation six or three or two printing formes, can be arranged side by side on the forme cylinder 05, in each case with two, one in front of the other. In one variant they can be embodied to alternatively accommodate two printing formes, each extending continuously over one-half the usable cylinder length, or six printing formes arranged side by side in the axial direction, depending upon operating requirements.

In one advantageous operating mode (mixed or hybrid production), at least one printing unit 01 of the printing press is used to print in coldset, for example, on a coldset web 02, and at the same time, the other printing unit 01 of the printing press is used to print in heatset, for example, on a heatset web 02' (with subsequent drying), and these webs 02; 02', and/or partial webs 02.*x*; 02'.y (x, y=1, 2, 3, . . . ) produced by cutting such webs lengthwise, imprinted in different processes, are guided to the same superstructure 06, or at least to the same turning device 07, more particularly, the same turning tower 07 of the superstructure 06, and ultimately to the same former structure 08.

The former structure 08 is preferably embodied as double-width, i.e., having two fold formers 09 (09.1; 09.2) arranged side by side—at least in one operating situation.

Figure 2:
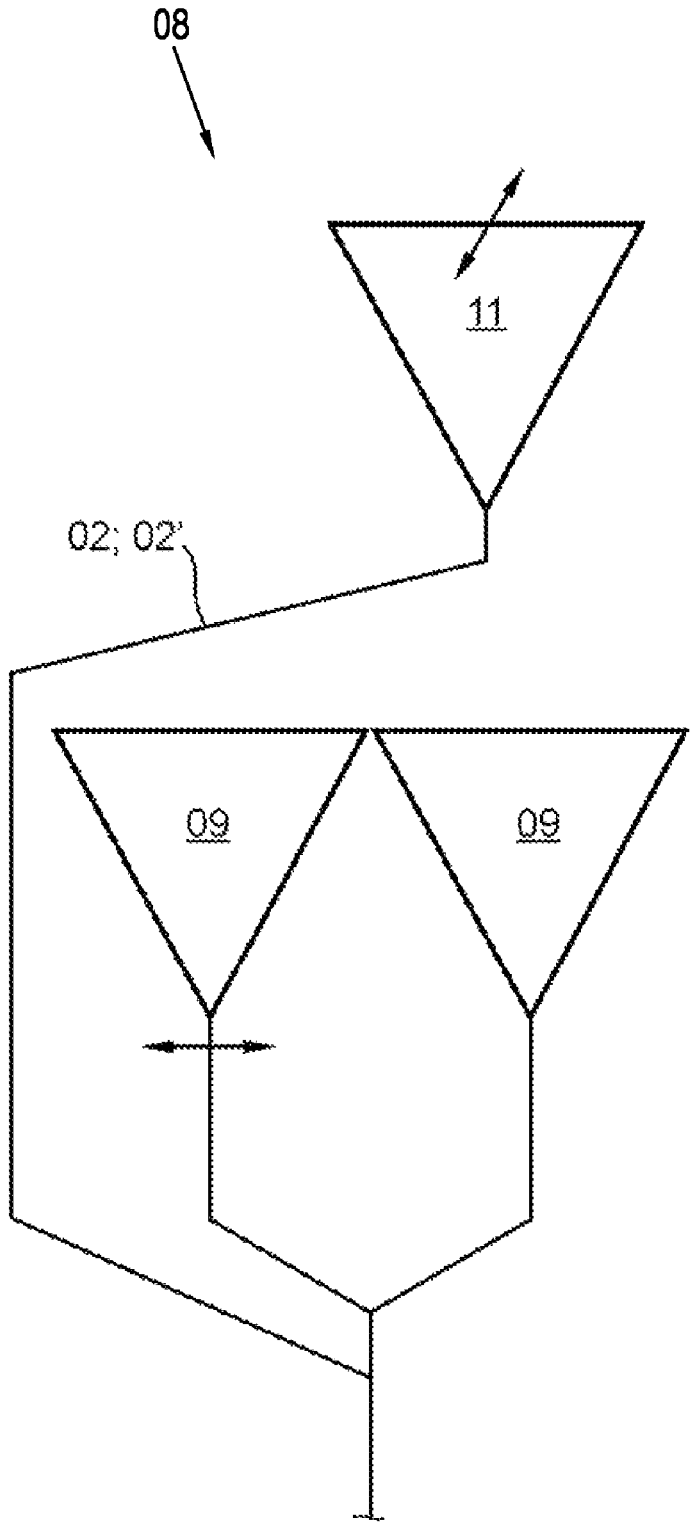
FIG. 2 a schematic view from the front of a former structure.

FIG. 2 shows a former structure 08 of an advantageous embodiment, wherein two fold formers 09 are provided in one former plane, and another fold former 11, for example, an individual former 11, is provided in a vertically offset former plane. The individual former 11 is movable at least longitudinally (i.e., horizontally in the direction of transport of the entering web 02; 02'), to allow the fold spine that is formed to be offset in relation to the fold spine that is formed by the fold former 09 positioned below this. The two lower fold formers 09 can preferably be embodied as adjustable in terms of the distance between their former noses. For this purpose, at least one of the two fold formers 09, in this case the left, for example, is embodied as movable transversely to the direction of web travel of an entering web 02; 02'. In this advantageous embodiment of the printing press, the former structure 08 is rotated, in terms of its direction of web travel of the incoming web 02; 02', 90° in relation to the machine alignment F or machine longitudinal direction M. In principle, however, a former structure 08 disposed in the machine alignment F and having a direction of travel of the incoming web 02; 02' which is parallel to the machine alignment F, can also be provided.

Figure 3B:
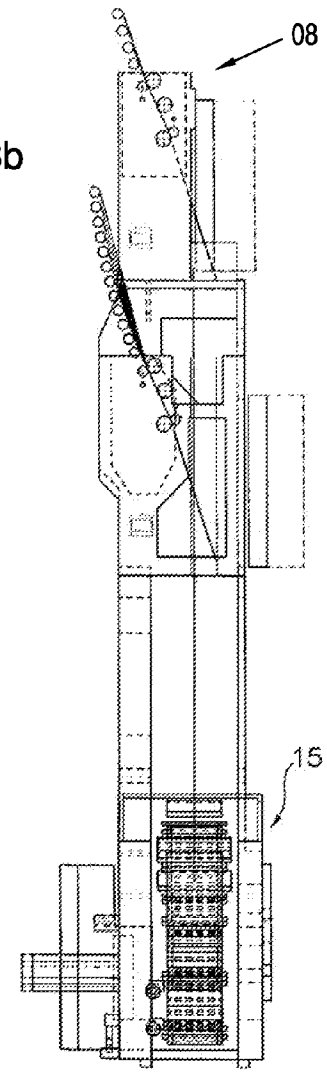
FIG. 3*b*) a side view of an embodiment of the former structure.
Figure 3A:
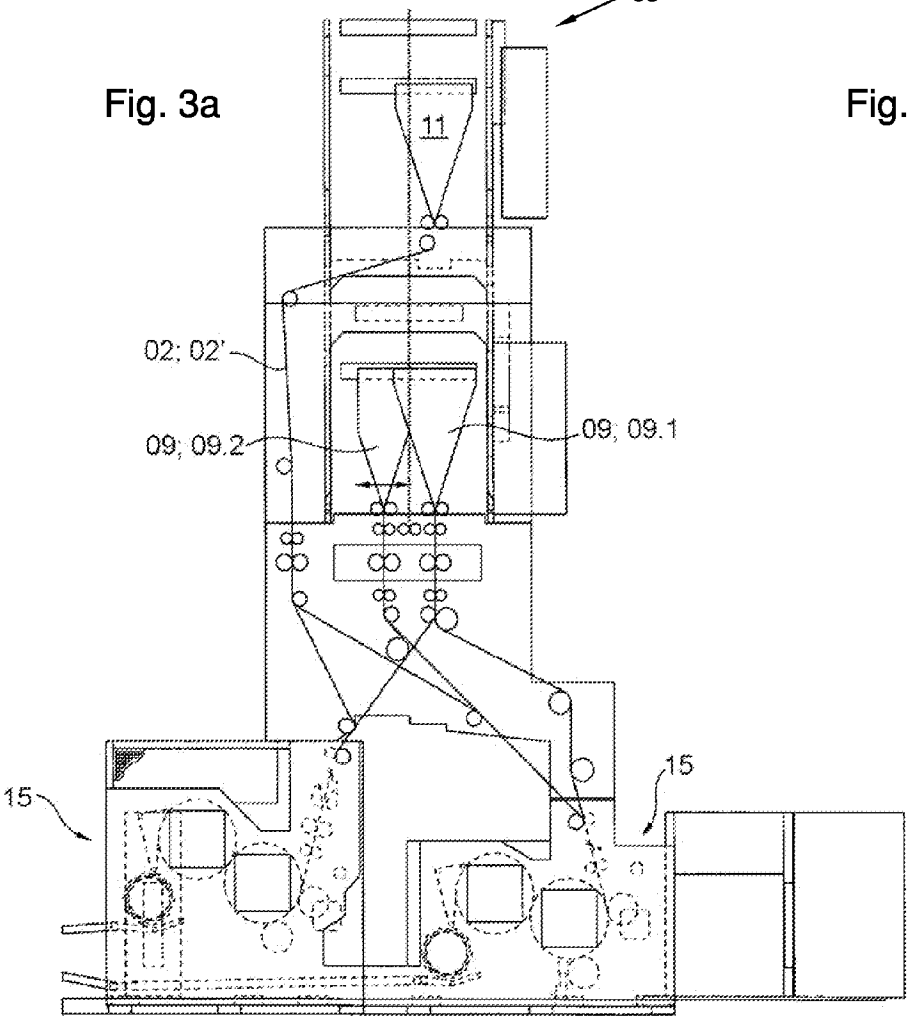
FIG. 3*a*) a front view of an embodiment of the former structure.

FIG. 3*a*) shows a detailed front view, and FIG. 3*b*) a side view, of one embodiment of the former structure 08, wherein in this case one of the two lower fold formers 09 (in this case, the left) is displaceable or displaced in relation to the other, for example. In one variant the two fold formers 09 can also be offset slightly from one another vertically (e.g., less than one-half the height of the former), to prevent them from interfering with one another, or, as is clear from FIG. 3*a*) and—particularly in the case of different usable widths, as will be described in greater detail below—can be configured in terms of the shape of their upper region to be collapsible, one into the other. In the collapsed state, an upper region of the wider fold former 09.1 is then active for a web or partial web to be fed to the narrower fold former 09.2. In this case, the two former noses are preferably at substantially the same height. In one variant—with former noses that are at substantially the same height—the longitudinal extension of the two fold formers 09.1; 09.2 can differ such that the upper edges thereof end at different heights. In this embodiment, during operation, the smaller or ultimately narrower fold former 09.2 can be moved laterally up to the wider fold former, without having them to "move into each other." The larger fold former 09.1 can continue to extend above the upper end of the smaller fold former 09.2 without collision.

Below the former structure 08, at least one folding unit 15, in this case two folding units 15, are arranged for further processing. Using these two folding units 15, different products can be produced and delivered simultaneously, wherein, for example, a newspaper product comprising two sections (for example, from coldset webs) is produced via the two lower fold formers 09, and a semi-commercial product (for example, from heatset webs 02) is produced on another former, for example, the individual former 11. In hybrid production (heatset webs and coldset webs together in one product), up to three sections can be produced from ribbons from the three fold formers 09; 11. In this embodiment comprising two folding units 15 situated downstream of the former structure 08, a second former structure 08' can be dispensed with. The two folding units 15 situated downstream can also be embodied as a so-called double folding unit.

In a variant illustrated in FIG. 1, two former structures 08; 08' can be provided in the same alignment with the turning tower 07, in which case, for example, one folding unit 15 is situated downstream of each of the former structures 08; 08'.

Advantageously, the two folding units 15 (for the shared former structure or for two different former structures 08; 08') are embodied as different, such that the one folding unit 15, in addition to the equipment of the other folding unit 15, has a stitcher and/or another longitudinal folding unit and/or a second cross folding unit.

The webs 02; 02' coming from the printing units 01, more particularly, partial webs 02.*x*; 02'.y produced from such webs, are guided to the former structure 08 via the turning tower 07. Webs 02; 02' having a width b of up to a maximum web width b_max that can be processed in the printing press or in the printing unit 01, which corresponds, for example, to a nominal width of the printing couple cylinders, i.e., to a maximum usable cylinder width for printing (e.g., 66"), can be imprinted in the respective printing unit 01. As long as these webs 02; 02' are wider than, for example, ⅔ the maximum web width b_max, they are each cut, before reaching the turning tower 07, into at least two partial webs 02.*x*; 02'.y, and are brought in a desired alignment via the turning tower 07 to the former structure 08 downstream.

To achieve a particularly high degree of flexibility in the products to be produced with the printing press, the turning tower 07 has, in addition to one shorter turning bar 16, for example, at least one turning bar 17, the length of which, projected onto the width of an exiting web ribbon, corresponds to at least the effective widths of two fold formers 09; 11 downstream and/or at least more than one-half, particularly at least two-thirds, of a maximum web width b_max (nominal width) to be processed in the printing press.

Figure 3C:
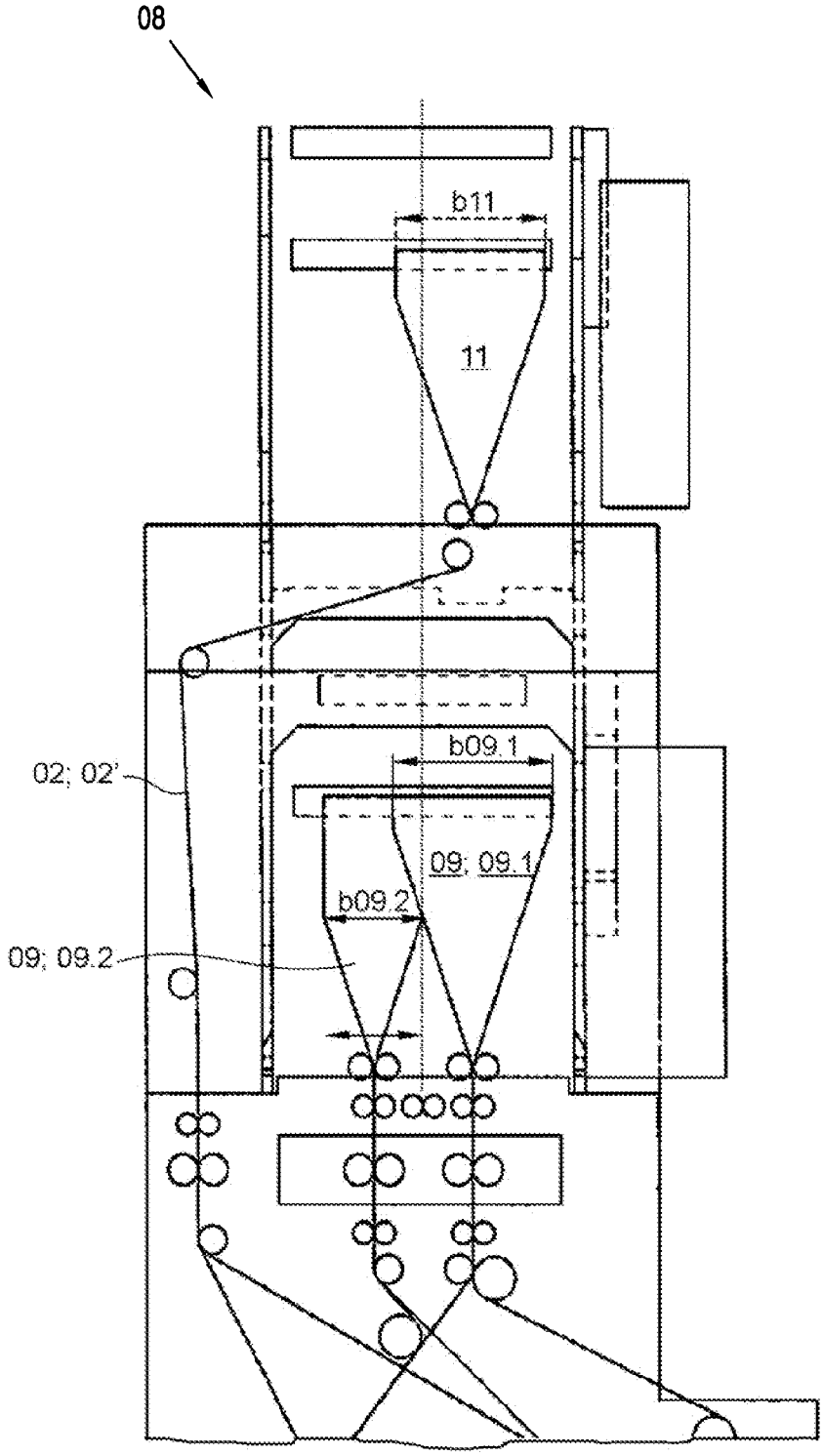
FIG. 3*c*) an enlarged detailed view of an embodiment of the former structure.

As is clear from FIG. 3, the two adjacent fold formers 09 in a same former plane can also have different maximum potential effective widths (usable widths). The one fold former 09.1 (in this case the right, for example) can have a usable effective width b09.1, which corresponds to significantly more than one-half the nominal width of the former structure (e.g., clear from the guide elements upstream and the imaginary center plane of the former structure). In one advantageous embodiment, this fold former—particularly in connection with the triple-width printing unit 01 arranged upstream—has a usable width b09.1, which corresponds to one-half the nominal width of a printing unit 01 arranged upstream in a web path. The description pertaining to the wider fold former 09.1 can advantageously be valid and applied to the usable width b11 of the additional fold former 11, in place of or advantageously in addition thereto. Given the nominal width of the printing unit(s) of 66", provided by way of example, the usable width b09.1 of the wider fold former 09.1 and/or 11 can preferably be about 33", wherein the narrower fold former 09.2 has a usable width b09.2 of 22", for example. Wider webs 02; 02' or partial webs 02.*x*; 02'.y, for example, wider than one-half the nominal width of the former structure 08, and/or, for example, up to one-half-width, i.e., webs 02; 02' or partial webs 02.*x*; 02'.y which have a width of up to one-half the nominal width of a printing unit 01 arranged upstream (e.g., triple-width), then can be and/or are guided over the fold formers 09 and/or 11. If the wider of the two fold formers 09.1 will be or is operated in this manner (e.g., first operating mode), and if the upper region thereof is configured to be telescoping, one into the other, then for this operating status, the smaller fold former 09.2 (in this case, the left) is to be or is moved laterally out of the web path of the web 02; 02' or partial web 02.*x*; 02'.y that is approaching the wider fold former 09.1 (parked position). In another (second) operating mode, illustrated by way of example, the two fold formers 09 are moved together (or the narrower fold former 09.2 is moved to its operating position) and are or can be traversed, for example, side by side, by webs 02; 02' or partial webs 02.*x*; 02'.y of equal width, more particularly, one-half the nominal width of the former structure 08 and/or one-third the nominal width of a printing unit 01 situated upstream and/or the effective width of the narrower fold former 09.2 (see also FIG. 12, right side). In this case, the wider fold former 09.1 is not active over its entire usable width.

The nominal width of the former structure 08 can correspond, for example, at least or substantially to the total of the fold formers 09.1; 09.2 situated side by side in the operating position, in other words, in this case significantly more than twice the usable width 09.2 of the narrower fold former 09.2.

The wider fold former 09.1 can preferably be arranged as stationary in relation to a direction transverse to the direction of web travel, wherein in this case, the upper region of this former, for example, projects beyond the imaginary center plane of the former structure 08 to the other side. The former nose can be situated the same distance from the imaginary center plane as the former nose of the narrower fold former 09.2 in its operating position. The overall width of the two fold formers 09.1; 09.2 moved together is then, for example, greater than two-thirds the nominal width of the printing unit(s) 01 arranged upstream, or greater than twice the usable width of the smaller of the two fold formers 09.2.

In contrast to add-on formers of greater width, in every operating mode the larger of the two fold formers 09.1 is located within the alignment of the nominal width of the former structure 08 that allows web feed, and/or is preferably used for both one and for the other operating mode, wherein, for example, in the case of the second operating mode, such a fold former has, on the side thereof that is closer to the exterior side of the machine, a region that is not covered by (partial) webs.

Figure 4:
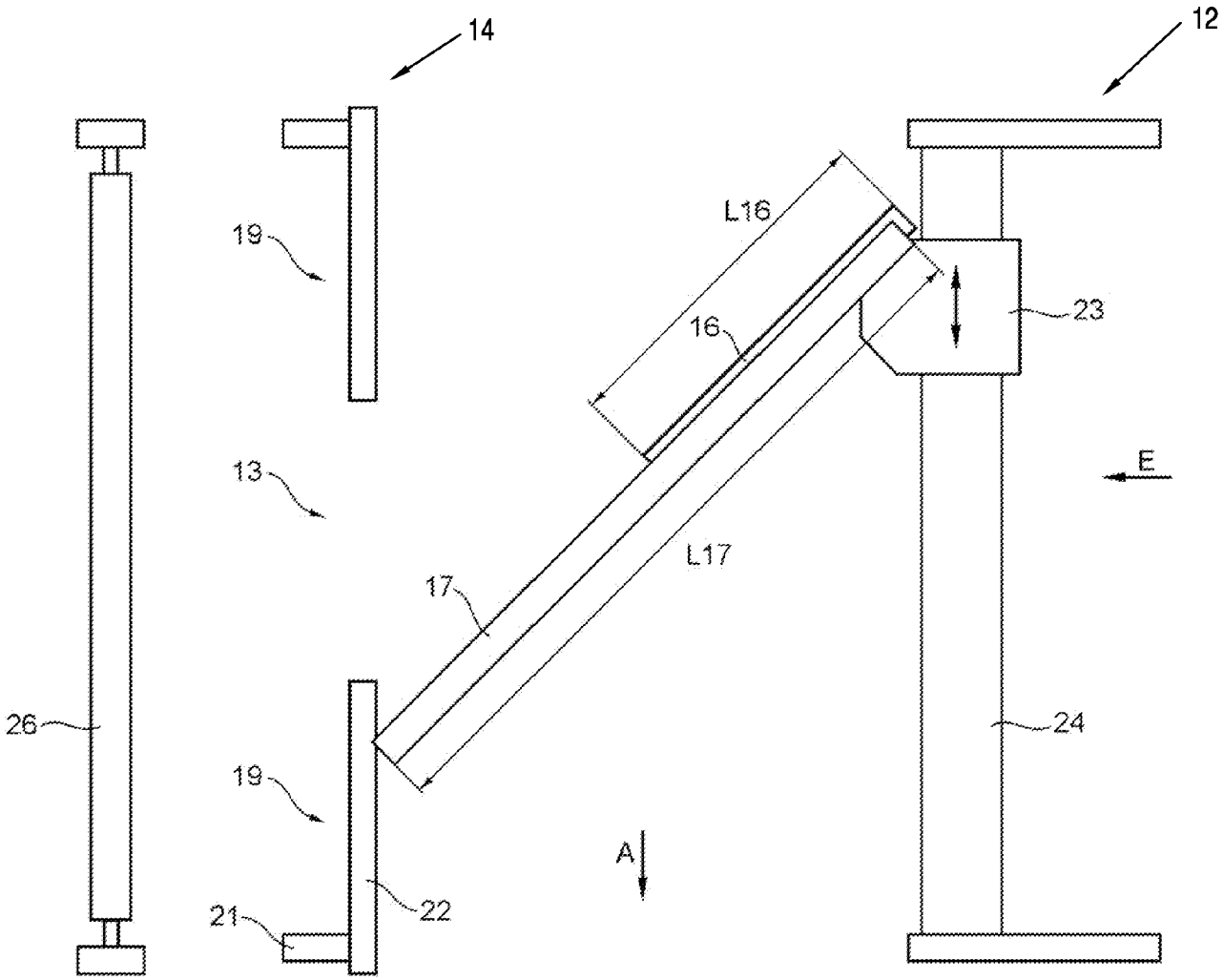
FIG. 4 a schematic plan view of a turning tower.

FIG. 4 shows a schematic plan view of the turning tower 07 with a first frame side 12 and with a second frame side 14. In one advantageous embodiment, the second frame side 14 is embodied as not continuous over the entire machine width, such that at least one access point 13, more particularly, one through opening 13 (at least 30 cm in width, for example), is provided in this frame side 14. This through opening 13 can extend over substantially the entire height of the turning tower 07, or at least over a height that will allow a press operator to enter the space between the frame sides 12; 14 from the second frame side 14. In FIG. 4, the through opening 13 is formed, for example, by providing frame sections 19 to the left and the right of a through opening 13. These frame sections 19 can comprise supports 22 mounted on a frame 21, which extend over only part of a width b07 of the turning tower 07. In the turning tower 07, at least one support 19 is provided for each frame section 19 of the same frame side, for example, the length of which support, in a plan view of the turning tower 07, is short enough to leave the aforementioned through opening 13. This length can be, for example, shorter than one-half the width b07, or at least overall (e.g., at least 30 cm) significantly shorter than the width b07 of the turning tower 07. In principle, supports 22 can also be provided on only one frame section 19, or a frame section 19 can be provided on only one side. What is essential is that, at least on one frame side 12; 14, a point of access 13 to the interior of the turning tower 07 is provided. In FIG. 4, both a shorter turning bar 16 having a length L16 and a longer turning bar 17 having a length L17 are shown, illustrating what is described in what follows.

The turning bar 16; 17 (either short or long) is preferably mounted, for example, on a guide 24, so as to be transversely movable, advantageously via a drive, not shown, more particularly, remotely actuable (e.g., via a control console and/or an automatic presetting system). For this purpose, the turning bar 16; 17 is mounted in the region of a first end on a carriage 23, which is mounted so as to be linearly movable on the guide 27, for example, on a cross-member 24 having a guide, but which can be locked in place in a desired position by the drive itself or by a mechanism provided specifically for this purpose. In its locked position, the locked turning bar 16; 17 is preferably held in place at its first end in all three directions in space. This preferably applies to the embodiment of the short and the long turning bar 16; 17.

At its second end, the short turning bar 16 is unattached, i.e., it is mounted cantilevered, and at the second end it is neither supported nor permanently fixed in any direction in space.

Figure 7C:
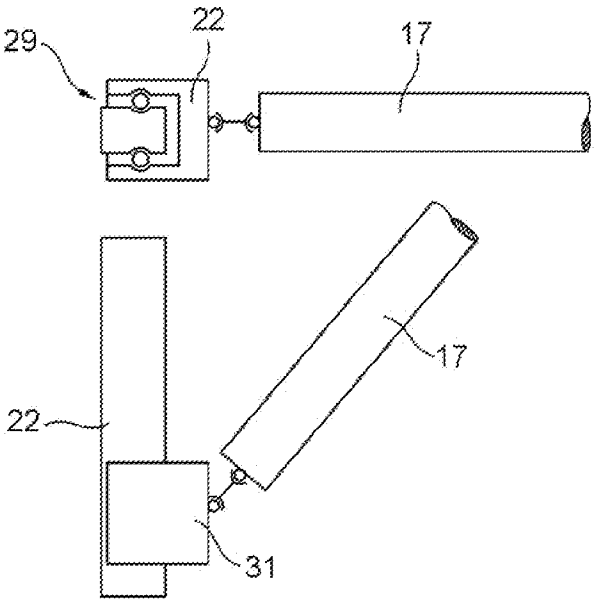
FIG. 7*c*) a third embodiment example for the mounting of a long turning bar.

The long turning bar 17 is preferably merely supported at its second end, and/or in any case its movement in two directions is space is blocked, in order to reduce sag caused by gravity and/or web tension (see FIG. 7).

Figure 5:
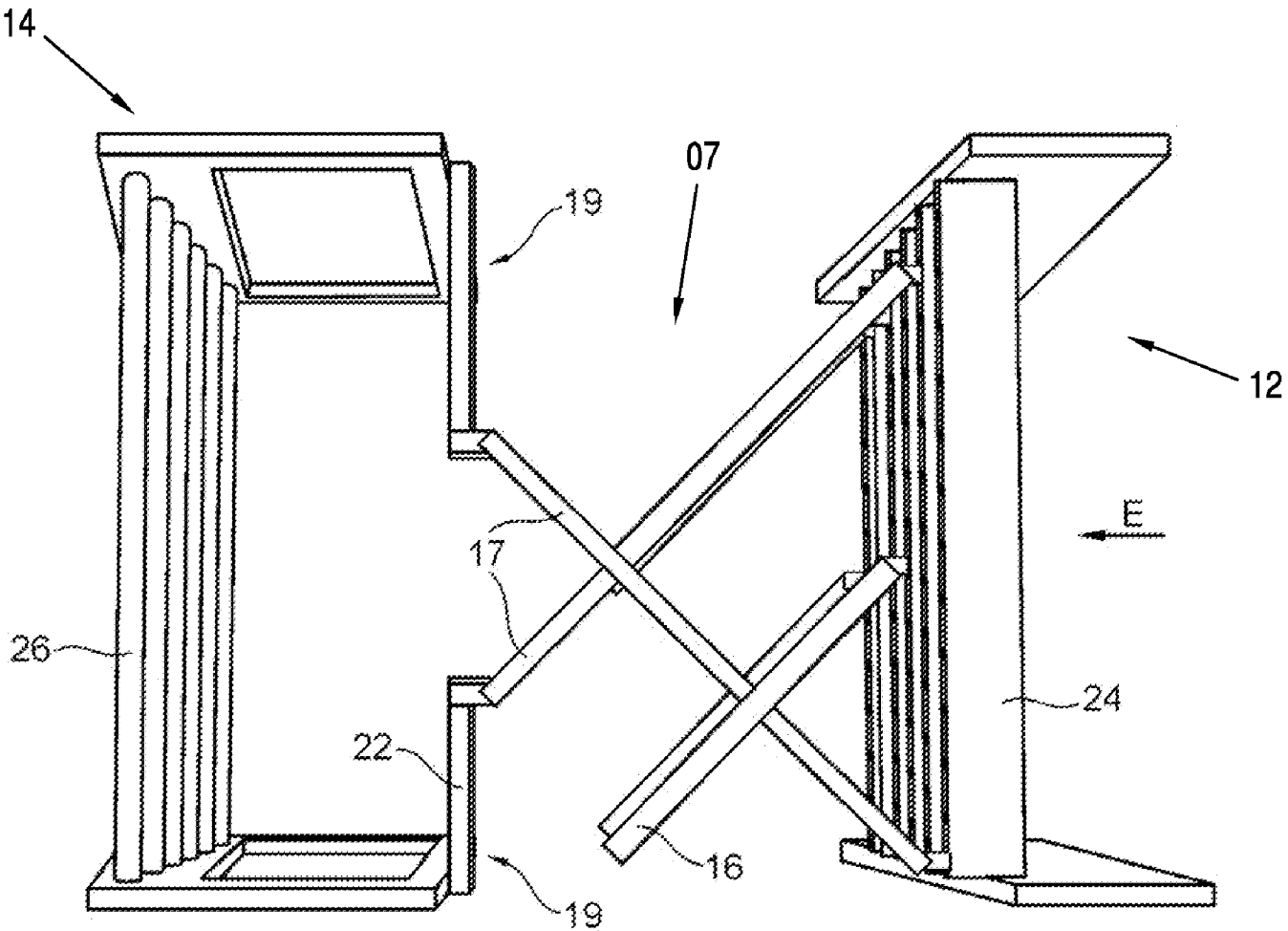
FIG. 5 a plan view of a turning tower with a plurality of planes.
Figure 6:
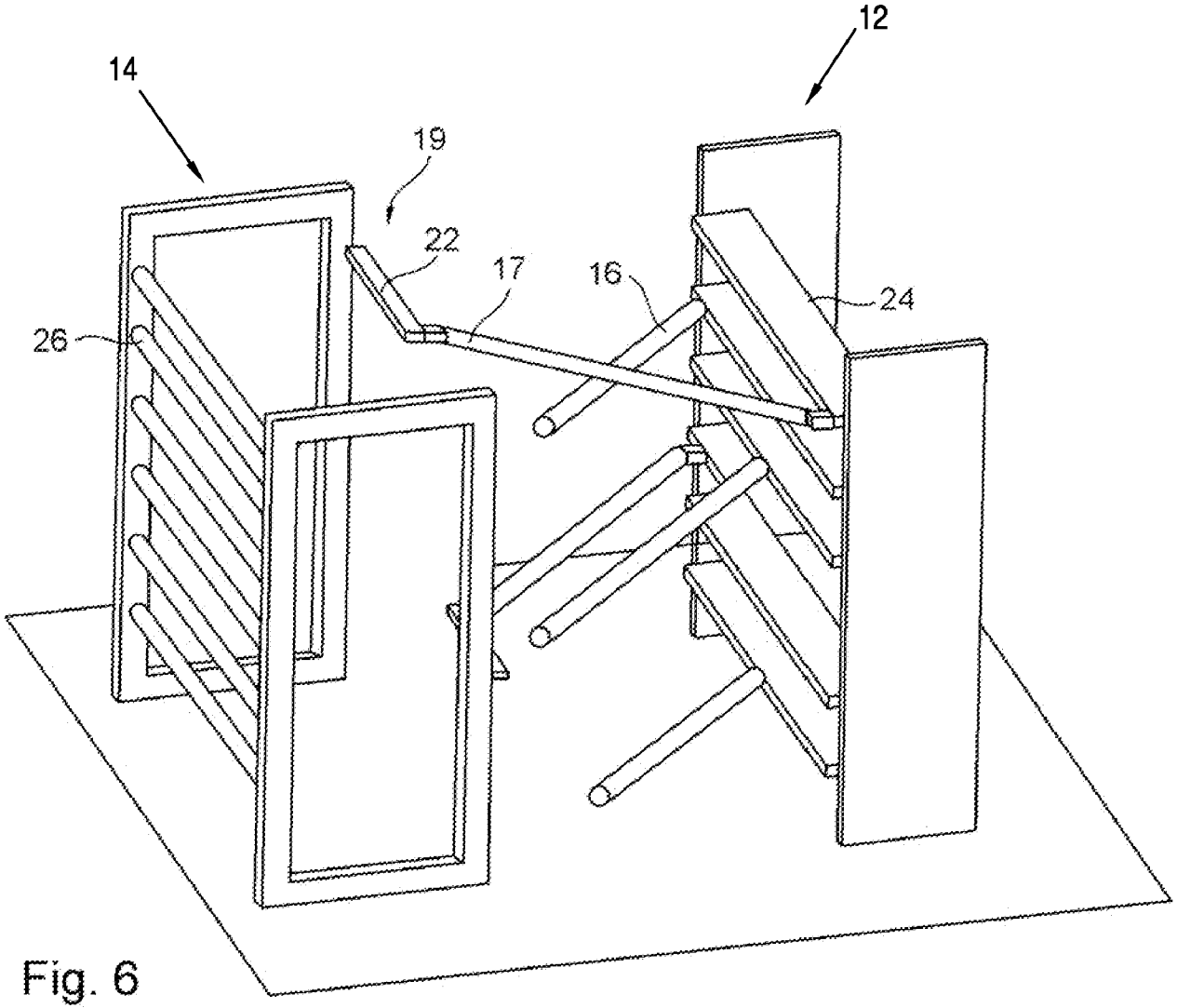
FIG. 6 a perspective illustration of a turning tower according to FIG. 5.

FIG. 5 and FIG. 6 show a plan view and a perspective view, respectively, of the turning tower 07, which in this case comprises a plurality of short turning bars 16 and at least one long turning bar 17, in different planes. FIG. 5 shows two long turning bars 17, which are angled differently in relation to the direction of a web ribbon intake E. The short and long turning bars 16; 17 are securely mounted in a locked position on the one frame side 12, whereas the long turning bars 17 are supported at their other end and the short turning bars 16 are mounted cantilevered. Preferably, a turning tower 07 is embodied to correspond to the printing press, such that for each of the printing towers 01 that can produce on the shared former structure 08, and/or for each full web 02; 02' having a maximum web width b_max corresponding to m vertical printed pages in a newspaper format (broadsheet), m/2 planes, each with at least one turning bar 16; 17, are provided. With n (e.g., n=2) full webs 02; 02' that can be guided to a former structure 08 (with n=1, 2, 3 . . . ) and web widths of m newspaper pages (e.g., m=6), this is a number of n*m/2, for example, 2*6/2=6 turning bar planes or turning decks. If at least one additional printing unit 01 or one additional group of printing units 01, for example, two additional printing units 01, are provided on the same machine side or on the opposite machine side from the turning deck, as shown in FIG. 1, the turning tower 07 is embodied, for example, as a plurality of stacked turning towers 07, for example, two, or as a turning tower 07 having a correspondingly greater number of turning decks (see, e.g., FIGS. 15 and 16), with at least twelve turning decks for the machine of FIG. 1 having a total of four printing units 01.

Preferably, at least one printing unit 01 is arranged on each of the two opposite sides of the turning tower 07, more particularly, on one side at least one heatset printing unit 01 with a dryer and on the other side at least one coldset printing unit 01, wherein the webs 02 coming from the two sides are or can be cut on the same side of the turning tower 07 (ribbon intake E) by longitudinal cutting devices 33, and these webs or the resulting partial webs 02.*x*; 02'.y will be or are fed from this same side (ribbon intake E) to the turning tower 07.

The additional printing unit 01 or printing units 01 of an additional group disposed on the other side of the turning tower 07, for example, are embodied as coldset printing units 01, for example, wherein in the web path thereof to the turning tower 07, for example, no dryers are provided. Preferably, in separate production (i.e., simultaneous and separate production of retail or semi-commercial products in the heatset printing unit 01 or the heatset printing units 01 and newspaper production in the coldset printing unit 01 or the coldset printing units 01, the webs 02 or partial webs 02.*x* imprinted in coldset printing units 01 are on the lower turning bars and the heatset webs 02 or partial webs 02'.y are on the upper turning decks or turning bars.

In addition to the turning bars 16; 17, the turning tower 07 can preferably have another group of rollers 26 offset vertically in relation to one another, for example, drop and/or bay window rollers 26. Advantageously, these are positioned on the frame side 14 having the through opening 13. These rollers 26 make it possible to guide webs 02; 02' or partial webs 02.*x*; 02'.y first through the turning tower 07, and using the rollers 26, to guide the web 02; 02' or partial web 02.*x*; 02'.y to the relevant turning bar 16; 17 at a desired height of the turning tower 07. Thus the individual webs 02; 02' or partial webs 02.*x*; 02'.y can be sorted in the manner of a fan into the desired section of the resulting ribbon bundle.

Figure 7B:
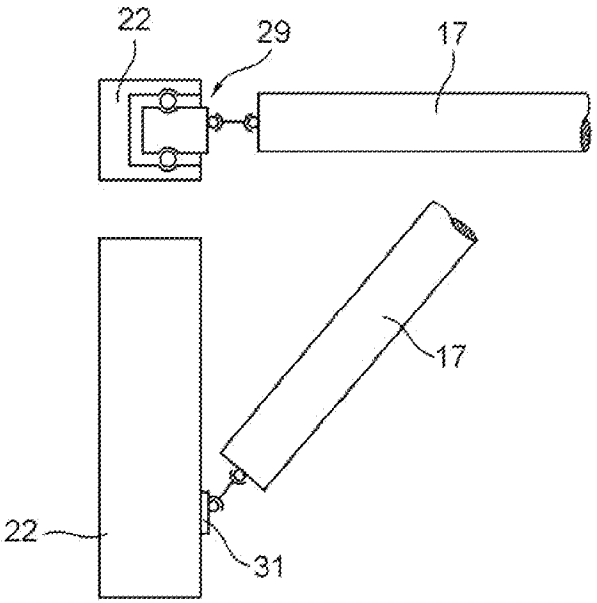
FIG. 7*b*) a second embodiment example for the mounting of a long turning bar.
Figure 7A:
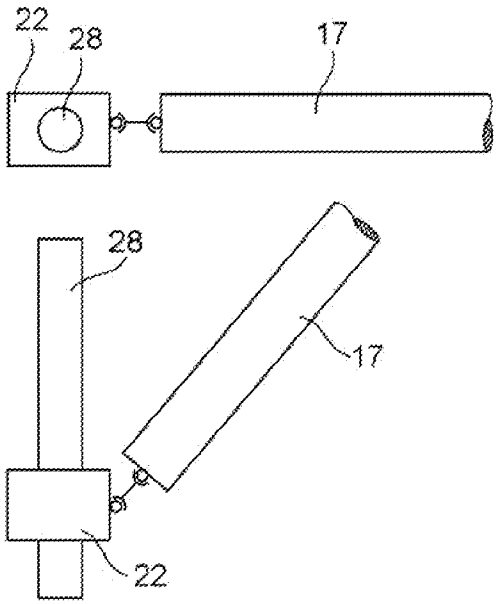
FIG. 7*a*) a first embodiment example for the mounting of a long turning bar.

FIG. 7*a*), b) and c) schematically illustrate three advantageous embodiments of the mounting configuration for the long turning bar 17, each from a side view and a plan view. Common to all is the fact that the end is not permanently fixed in all directions in space, rather movement in at least one direction in space, in this case the direction transversely to the entering web 02; 02', is permitted.

FIG. 7*a*) shows the turning bar 17 supported on a carriage 27, which is disposed on a spindle 28 so as to be longitudinally displaceable. In this case, the spindle 28 can be disposed on a support 22, or can advantageously take the place of the aforementioned support 22. The turning bar 17 can be attached to the carriage 27 stationarily or, as shown here, in an articulated connection.

In FIG. 7*b*) and c), the basis of the support is a linear guide, for example, via corresponding parts of a linear bearing. In this case, for example, the support 22 or a bearing part attached to the support 22 comprises the stationary part of a linear bearing 29, whereas the corresponding bearing part is provided on a carriage 31 that is connected to the end of the turning bar 17. Between support 22 and carriage 31, roller elements can be provided in correspondingly shaped bearing grooves—as shown. Whereas in FIG. 7*b*) the stationary bearing parts surround the bearing parts of the carriage 31, in FIG. 7*c*), the bearing parts of the carriage 31 surround the stationary parts. The turning bar 17 can be connected to the carriage 31 in a stationary connection, or, as shown here, an articulated connection.

In principle, stationary long turning bars 17 can be provided in one or more planes. However, it is advantageous for the assembly to be variably adjusted—at least to a minimal degree. Therefore, in a first variable embodiment, at least one of the carriages 23 shown in FIG. 4 is embodied in such a way that it can be equipped alternatively with a short or a long turning bar 16; 17. This alternatively equipped carriage 23 is then provided, for example, on the cross member 24 of the plane which corresponds to a support 22 on the other frame side 14. Then, when a long turning bar is to be used in place of a short turning bar 16 in the relevant plane, the latter bar can be removed and the former inserted.

Figure 8:
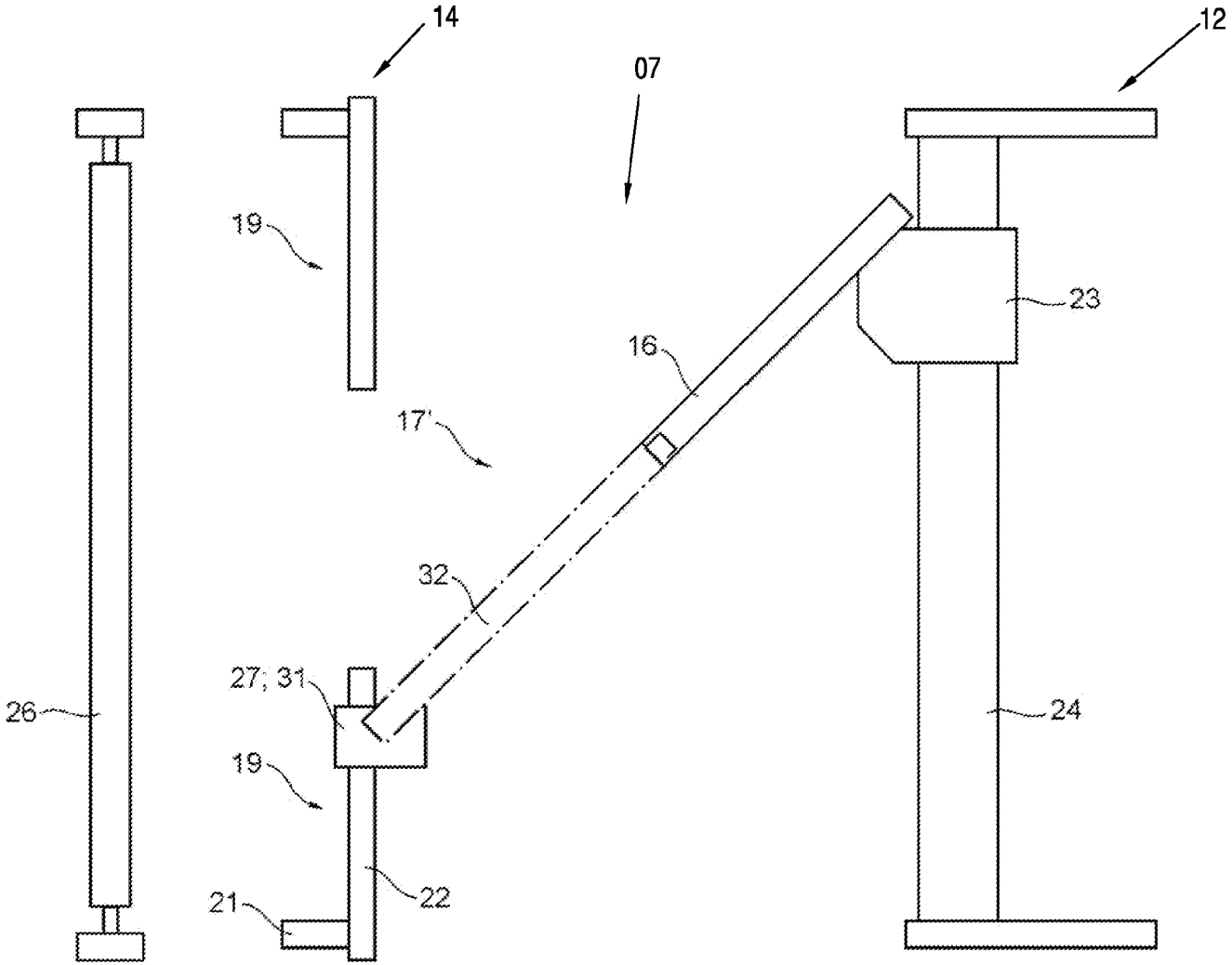
FIG. 8 an embodiment of an extendable turning bar.
Figure 9:
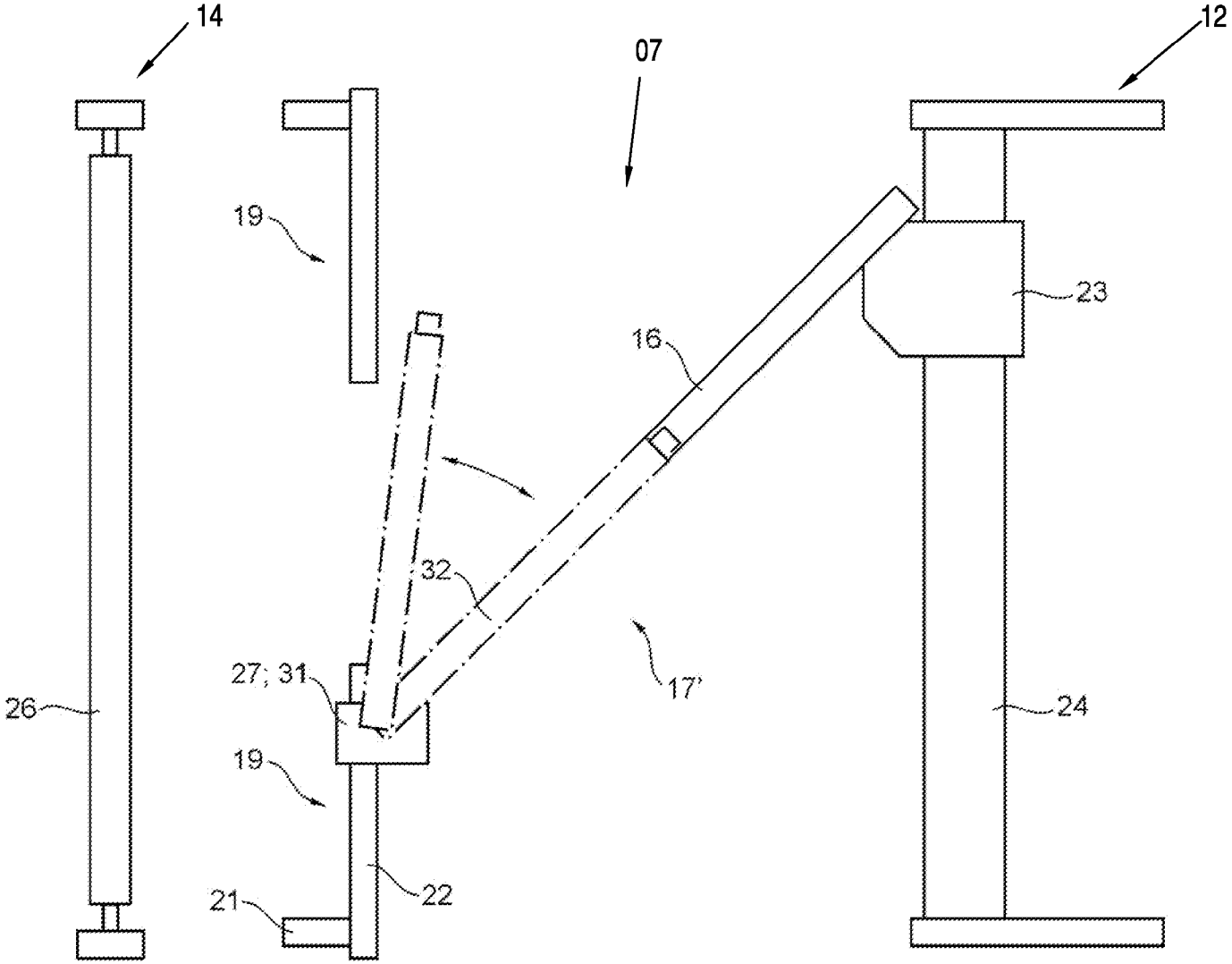
FIG. 9 an embodiment of an extendable turning bar.

In a second variant shown in FIG. 8, at least one of the short turning bars 16, more particularly, at least the short turning bars 16 in those planes in which long turning bars 17' will also be used, is embodied as extendable. For this purpose, in one variant, for example, a tapered pipe section of an extension piece 32 can be inserted into the open end surface of the short turning bar 16 (or vice versa), to create a long turning bar 17. The end of the extension piece 32 that is opposite the connection point can then be supported as described. In a further advantageous development, the extension piece 32 is pivotably disposed on the carriage 27; 31, for example, wherein in the idle position it is pivoted out of the working area, and as needed it is pivoted in and connected to the short turning bar 16 (FIG. 9). In this case, insertion of one into the other can optionally be dispensed with, and instead, a locking mechanism can be provided on a side that faces away from the web 02; 02'.

However, the extension piece 32 can also be suspended—for example, from above—in a bracket (e.g., with an opening in a pin arranged on the carriage 27; 31).

Figure 10:
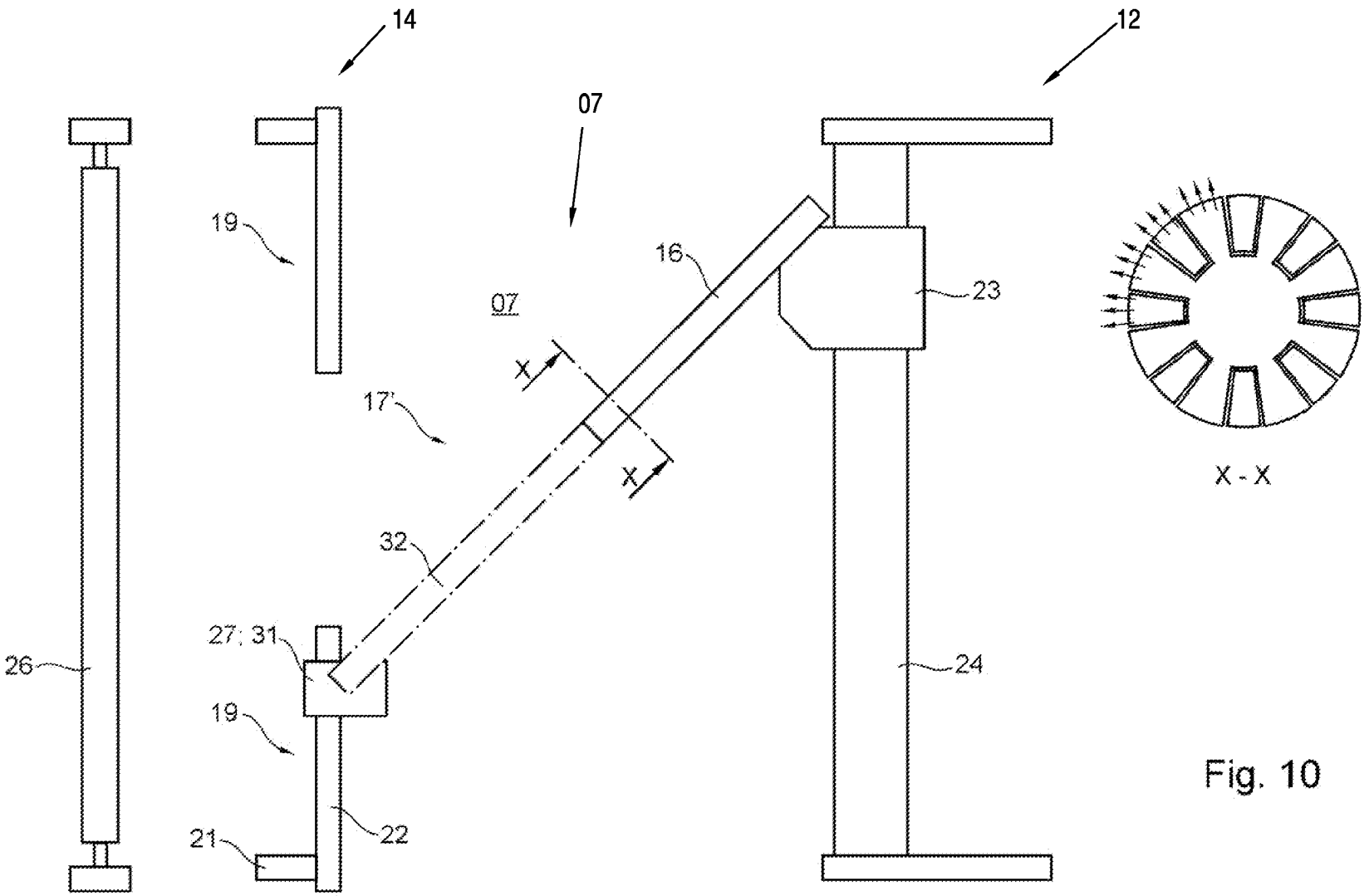
FIG. 10 an embodiment of an extendable turning bar.

In a variant illustrated in FIG. 10, at least the turning bar 17' for that (those) plane(s) in which long turning bars 17' will also be used can be embodied as telescoping. Of course, the sections should not form a step, therefore in one advantageous embodiment, two telescoping turning bar elements are each surrounded by an encasing element having substantially the same radius. For example, these are lamellar structures arranged in the circle and having air outlet openings on the outer surfaces thereof. These structures can then be collapsed into one another or telescoped out of one another. In the collapsed state, the surfaces of the two elements would extend in the circumferential direction to essentially form a circle.

With the specified embodiment of the turning tower 07—particularly combined with the aforementioned configuration of the forme cylinders 05 (e.g., with respect to possible printing formes) and/or printing units 01; 01 and/or the angled alignment of the former structure 08 and/or the configuration of the former structure 08 itself—a highly variable division of entire webs 02; 02' into the widest range of partial webs 02.*x*; 02'.y in terms of number and width is possible.

To allow the full web 02; 02' to be cut into partial webs 02.*x*; 02'.y, one longitudinal cutting device 33, having at least one blade 34, more particularly, having at least two blades 34, is provided for each web 02; 02' or for each printing tower 01. This blade 34, advantageously at least two blades 34, of the longitudinal cutting device 33 is or are embodied as movable transversely to the direction of web travel, i.e., positionable in a controlled fashion. It is thereby possible to cut the full web 02; 02' into strips, i.e., partial webs 02.*x*; 02'.y, of different widths as needed. At least a plurality of these blades 34 of a longitudinal cutting device 33 are preferably positionable independently of one another. Preferably, longitudinal cutting devices 33 having a different number of blades 34 are provided one above the other. For instance, two longitudinal cutting devices 33 have only three blades 34, for example, one center, stationary blade and two movable blades 34 on the two sides thereof, whereas at least one longitudinal cutting device has at least four blades 34 side by side, which are preferably embodied as individually movable and positionable.

Figure 20A:
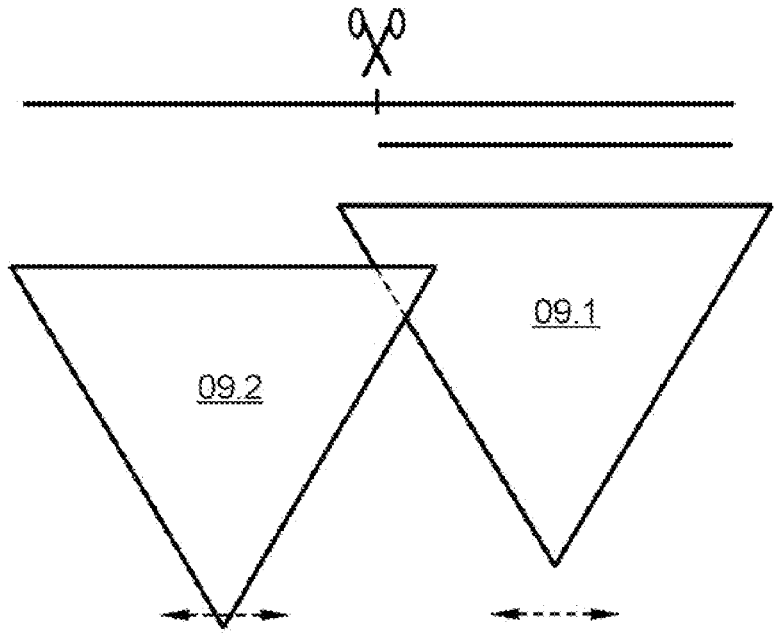
FIG. 20*a*) an illustration of a former arrangement corresponding to the operating mode according to FIG. 11 in a first embodiment of the two fold formers.
Figure 20B:
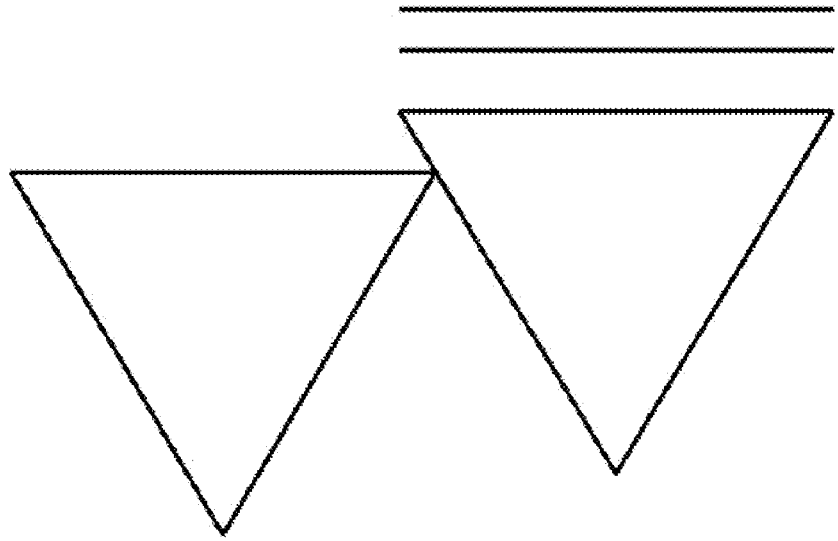
FIG. 20*b*) an illustration of a former arrangement corresponding to the operating mode according to FIG. 4 in a first embodiment of the two fold formers.
Figure 21A:
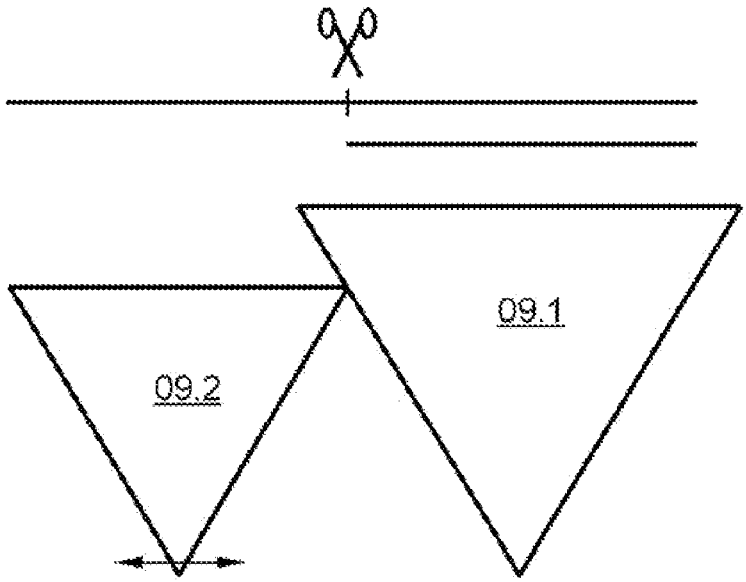
FIG. 21*a*) an illustration of a former arrangement corresponding to the operating mode according to FIG. 11 in a second embodiment of the two fold formers.
Figure 21B:
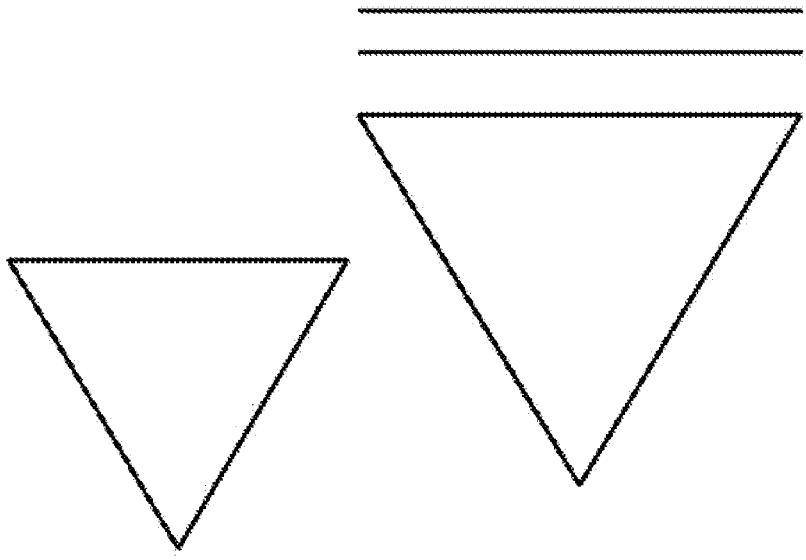
FIG. 21*b*) an illustration of a former arrangement corresponding to the operating mode according to FIG. 4 in a second embodiment of the two fold formers.
Figure 22A:
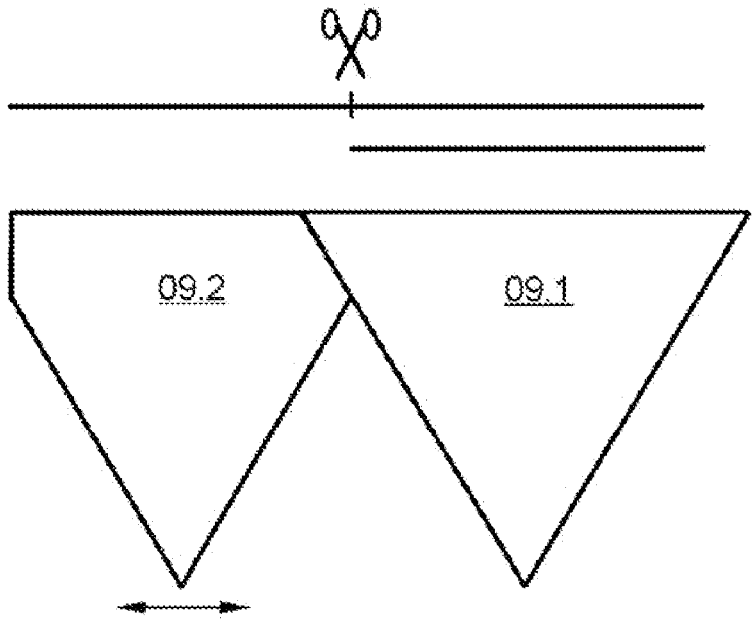
FIG. 22*a*) an illustration of a former arrangement corresponding to the operating mode according to FIG. 11 on a third embodiment of the two fold formers.
Figure 22B:
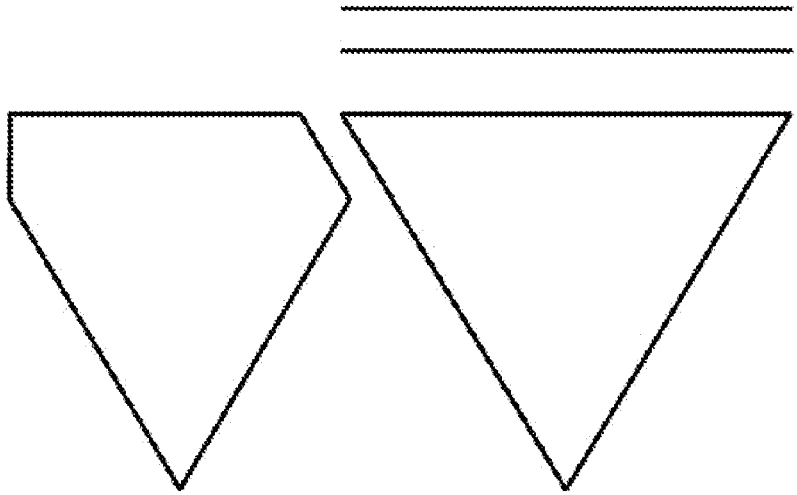
FIG. 22*b*) an illustration of a former arrangement corresponding to the operating mode according to FIG. 4 in a third embodiment of the two fold formers.

FIGS. 11 to 14 show production/web path examples, which can be generated individually or alternatively using the turning tower 07, more particularly, with the printing press having the turning tower 07. This is illustrated in each case for only one web 02; 02' imprinted in a printing unit 01. In principle, this can be a heatset or a coldset web 02; 02'. Because FIGS. 11 to 14 focus on the web path, the arrangement of the fold formers 09 (09.1; 09.2) has been illustrated merely schematically and without the details of a concrete embodiment described in reference to FIG. 3. However, the embodiments specified in detail above and illustrated in FIG. 3 can be applied to these examples, as is illustrated by way of example for the web paths of FIG. 11 and FIG. 14 as web path and/or operating mode a) and b), each for the fold formers 09.1; 09.2, in FIG. 20 (e.g., for at least one laterally movable fold former, more particularly, two that are laterally movable in opposite directions, of equal or different size, and slightly offset vertically; in principle, however, the offset fold formers 09.1; 09.2 can also both be laterally stationary), FIG. 21 (for one smaller and one larger former, offset vertically in the upper region, wherein the smaller former is laterally movable, for example), and FIG. 22 (for one wider and one narrower former, having a recess), each again from a front view.

Figure 11:
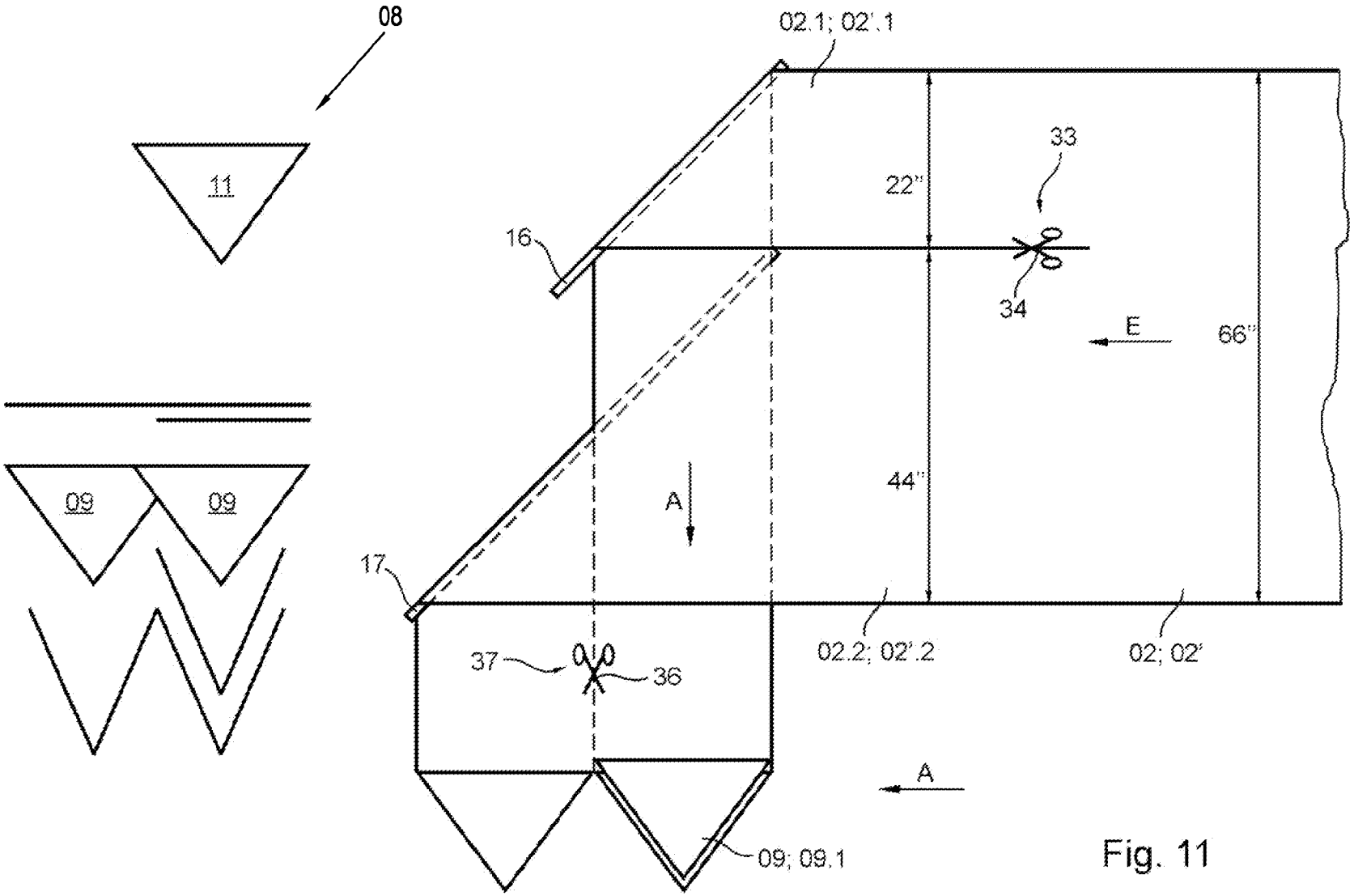
FIG. 11 a first production/web path example.

In one operating mode according to FIG. 11 (FIG. 20*a*, 21*a*, 22*a*), a web 02; 02', the width of which corresponds to six vertical newspaper pages, for example, is imprinted in a printing unit 01 and, before reaching the turning bars 16; 17 of the turning tower 07, is cut by the longitudinal cutting device 33 into two partial webs 02.1; 02'.1; 02.2; 02'.2 of different widths. The width of the first partial web 02.1; 02'.1 is, for example, one-third (for example, 22") that of the full web (for example, 66"), and the width of the second partial web 02.2; 02'.2 is two-thirds (for example, 44") that of the full web 02; 02', for example. In the turning tower 07, the wider partial web 02.2; 02'.2 is guided to the long turning bar 17, and the narrower partial web 02.1; 02'.1 is guided either also to a long turning bar 17, or preferably to a short turning bar 16, and is deflected by the turning bars 16; 17 90° to the former structure 08. Here, the narrow partial web 02.1; 02'.1 is guided to the former alignment that is closer to the ribbon intake E and/or the printing unit 01 that imprints the web 02; 02', and is deflected by a short turning bar 16 in a direction of a ribbon output A. The wider partial web 02.2; 02'.2 is deflected uncut, and, downstream of the turning tower 07 and before reaching the former structure 08, is cut lengthwise along a main cutting line, i.e., in an alignment lying between the two fold formers 09 arranged side by side, by means of a blade 36 of another longitudinal cutting device 37. On the left side of FIG. 11, the approach of the partial webs 02.1; 02'.1; 02.2; 02'.2 to the former structure 08 is illustrated schematically from a front view, along with the resulting folded ribbons.

This operating mode can be applied, for example, in connection with a web 02 imprinted in coldset—particularly with newspaper pages in broadsheet format.

Figure 12:
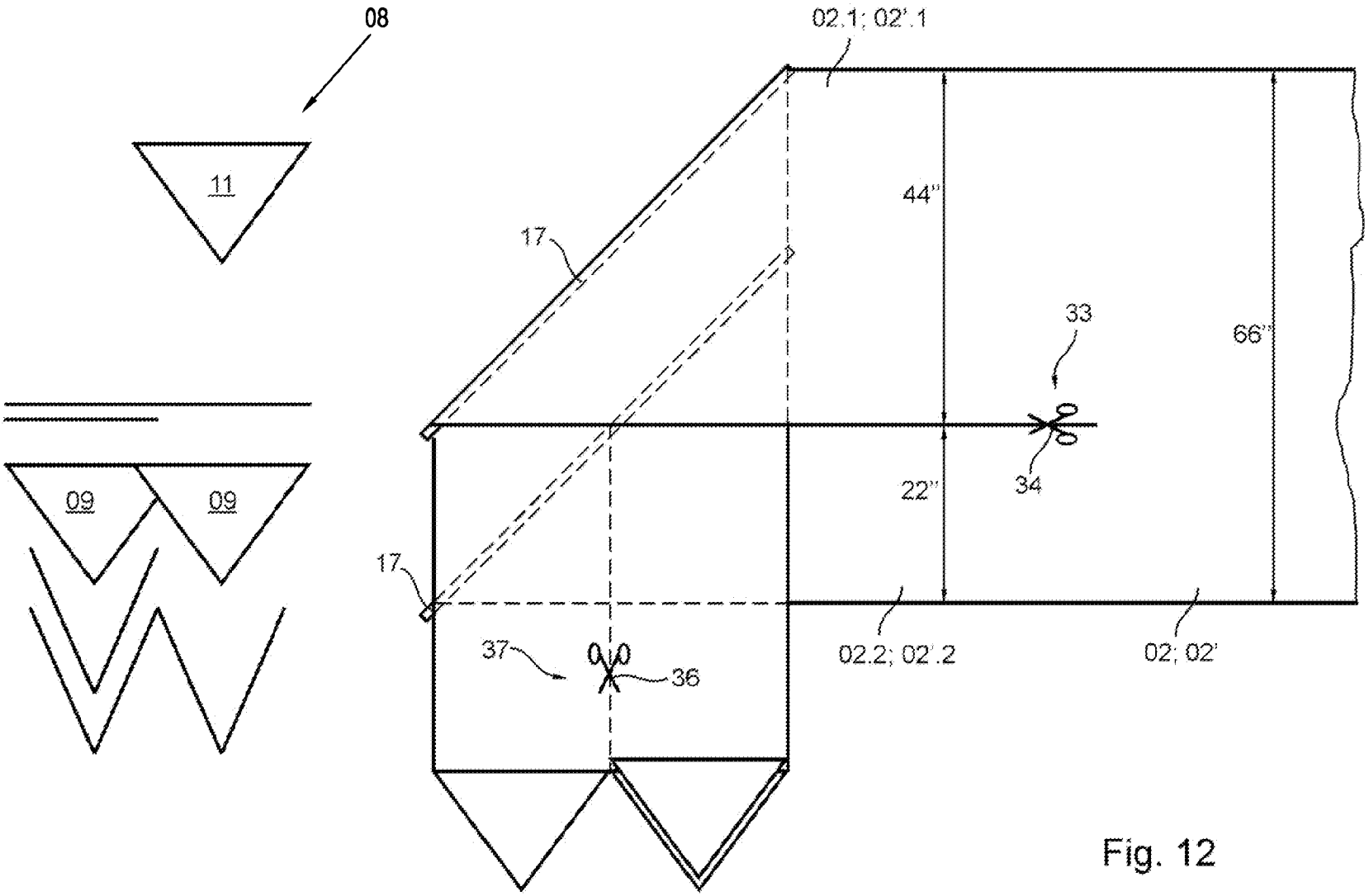
FIG. 12 a second production/web path example.

In contrast to FIG. 11, FIG. 12 shows a similar operating mode to FIG. 11, however, in this case the narrower partial web 02.1; 02'.1 is guided to the former alignment that is more distant from the ribbon intake E, and is deflected by a long turning bar 17. This is expressed in the product by the fact that the narrower partial web 02.1; 02'.1 is then allocated to the ribbon of the more remote fold former 09.

Figure 13:
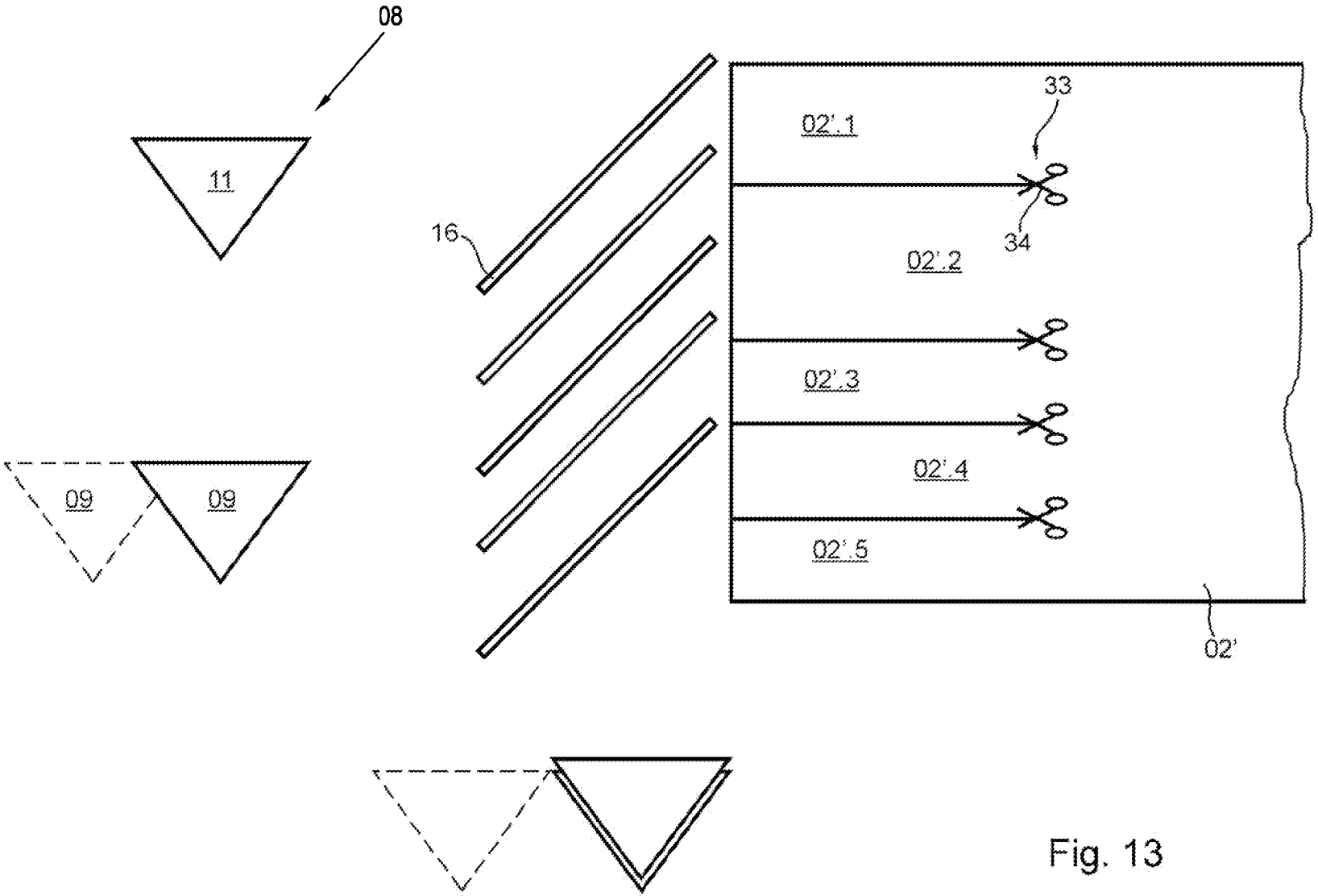
FIG. 13 a third production/web path example.

FIG. 13 shows a production/web path example for an operating mode, particularly for a semi-commercial or "retail" production with a web 02' imprinted, for example, in heatset (and dried—thermally or UV). In this case, the web 02' is cut into more than two partial webs 02'.1; 02'.2; 02'.3; 02'.4, for example, each measuring at most ⅓ of the maximum web width b_max. In one advantageous embodiment, these can all be guided to only one former alignment, for example, to the fold former 09 with the short turning bars 16 lying in the same alignment. In this case, it can be advantageous for some of the partial webs 02'.1; 02'.2; 02'.3; 02'.4 to be guided to the lower fold former 09 and some of the partial webs 02'.1; 02'.2; 02'.3; 02'.4 to be guided to a fold former 11 in the same alignment, lying above the other. Alternatively, however, these webs can also be guided some via short turning bars 16 to the fold former 09 having short turning bars 16 lying in the same alignment, and some via long turning bars 17 to the other, adjacent fold former 09.

Figure 14:
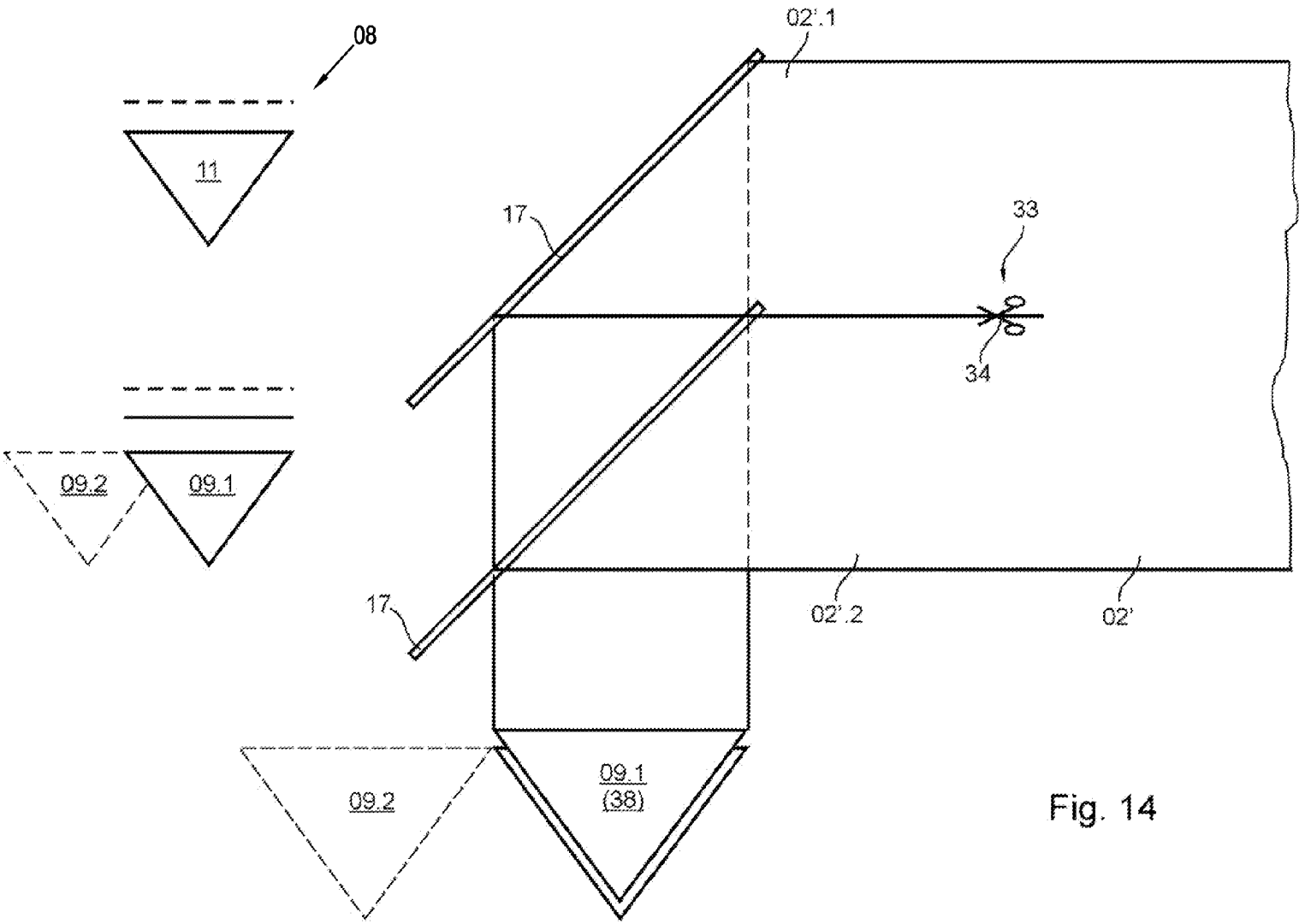
FIG. 14 a fourth production/web path example.

FIG. 14 (FIG. 20*b*, 21*b*, 22*b*) shows a production/ribbon path example for the operating mode, wherein, for example, two half webs or partial webs 02.1; 02'.1; 02.2; 02'.2, for example, from the same initial web are each guided over long turning bars 16 to the same fold former or to wider fold formers 09.1; 11 lying in the same alignment.

The web 02' imprinted, particularly, for the operating mode, for example, in heatset, according to FIG. 13, is preferably imprinted by a printing unit 01 comprising forme cylinders 05, which have one printing forme that extends over the entire effective width, or at least two printing formes, each extending over one-half the effective width. For the present dimension of a width corresponding to six vertical newspaper pages in broadsheet format, side by side, the printing formes are six pages wide each in the first case and three pages wide each in the second case (referred to a newspaper format). In this operating mode, the printing forme, which is six pages wide or three pages wide, is capable not only of supporting a number of print images of equal width side by side, for example, but can instead have print images of different widths side by side. In this context, the different widths refer not only to a situation that is comparable to the application involving panoramic pages, but more particularly, comprises cases in which the different widths are not all related to one another by a factor of 1 or 2. In another operating mode, for example, coldset, these forme cylinders 05 can then be loaded, for example, with six printing formes that are a single page in width or three formes that are two pages in width, or a combination thereof.

Transfer cylinders, which are not specified in detail here, can preferably have printing blankets, which extend over the entire effective width and optionally over the full circumference of the transfer cylinders. In this case, however, two printing blankets of this type can also be arranged one in front of the other in the circumferential direction. Preferably, this printing blanket or these printing blankets is/are embodied as metal printing blankets.

Preferably, the longitudinal cutting device 33 has more than two (in this case, for example, four) blades 34, more particularly, blades 34 that are positionable transversely to the direction of travel. It is thereby possible to create variability in the partial web width of the partial web 02'.2 indicated in FIG. 13.

Figure 15:
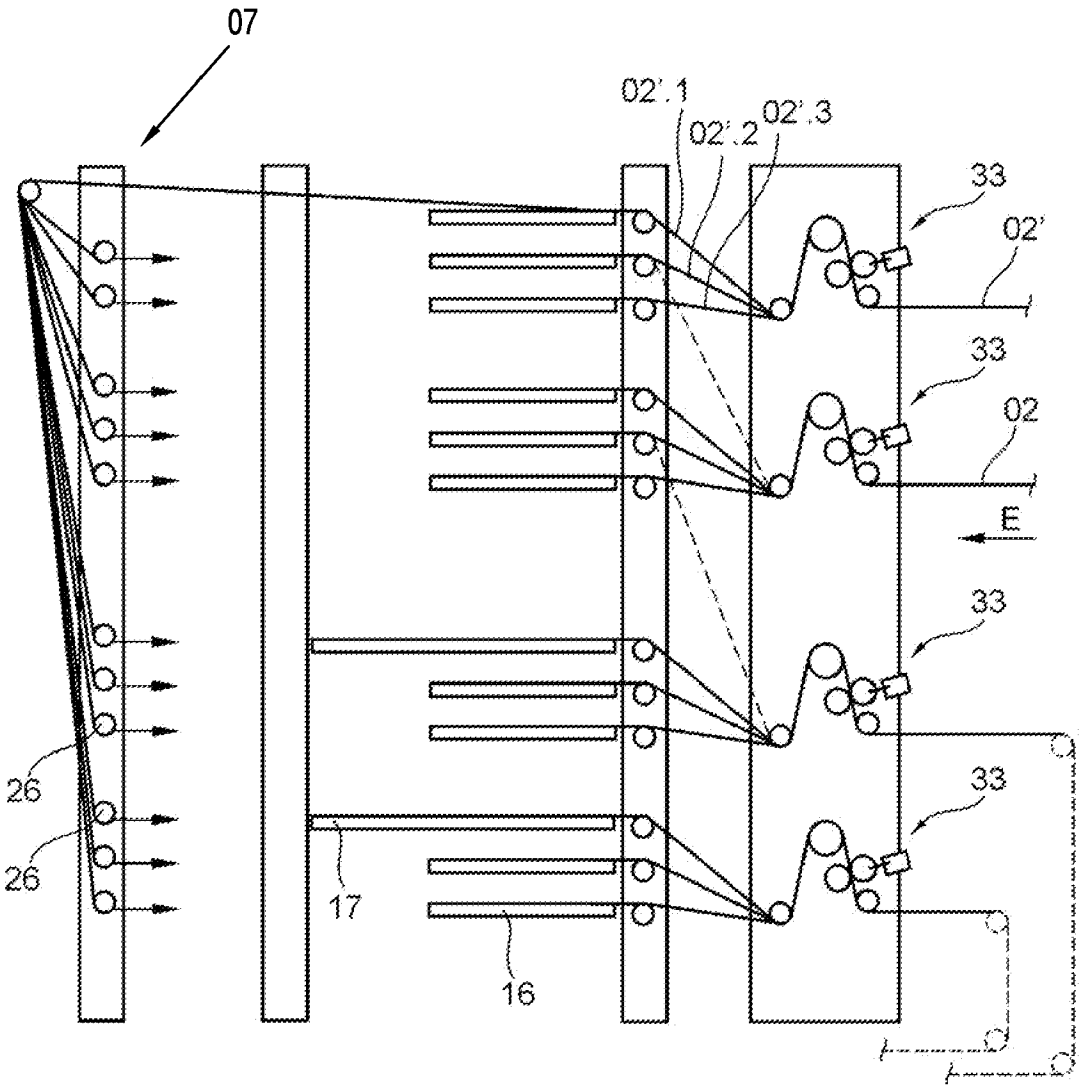
FIG. 15 an example of the path of partial webs in the turning tower.

An increase in the variability that can be achieved with the turning tower 07 involves the presence of the aforementioned rollers 26 on the side of the turning bars 16; 17 opposite the ribbon intake E (FIG. 15). An imprinted web 02; 02' or a partial web 02.*x*; 02'.y produced by longitudinal cutting can then be fed first from the side of the ribbon intake E through the turning tower 07, and on the other side, at a desired height, can be reintroduced as a section in the ribbon to be produced, and guided over the turning bar 16; 17. This is particularly advantageous when, for example, a higher quality imprinted web 02' and/or a web having a different print substrate, for example, a web 02' imprinted in heatset, and/or a web 02' having a higher paper quality and/or a different basic color, will be processed with webs 02 or partial webs 02.*x* of a different quality and/or a different print quality (e.g., coldset) to produce one or more mixed ribbons.

FIG. 15 shows a production/web path example for a mixed product made of coldset and heatset webs 02; 02' and/or web ribbons, with a plurality of possible alternative paths, wherein webs 02; 02' or partial webs 02.*x*; 02'.y can be guided from both sides to the turning bars 16; 17 of the turning tower 07, and can thereby be brought in the manner of a fan to a desired place (section) in the product. However, the webs 02; 02' are preferably fed to the turning tower 07, more particularly, to the longitudinal cutting devices 33, from one side. For example, a first web 02' (in this case the uppermost) is imprinted upstream in heatset and dried, and is then cut into partial webs 02'.y. One or more additional webs 02 is or are imprinted in coldset and are also cut into partial webs 02.*x*. Then, when a partial web 02;.y imprinted in heatset is to be provided at different positions in partial webs 02.*x*; 02'.y guided one above the other, then the partial webs 02'.y originating from the same web 02' can be guided through the turning tower 07 and reintroduced at the correct height. The turning bars 16; 17 ("fans") to be occupied by the partial webs 02'.x to be introduced are then kept open, by a corresponding upward or downward shift in configuration, with partial webs 02.*x* coming from the side of ribbon intake E (not illustrated, but merely indicated by dashed paths).

In the embodiment shown in FIG. 15, the turning tower 07 is configured with twelve planes, i.e., twelve decks, corresponding to a possible guidance of twelve partial webs 02.*x*; 02'.y as described above, for example, from four full webs, six pages in width. This turning tower 07 can then be embodied as a turning tower 07 of corresponding height or can consist of a plurality of stacked modules. In the illustrated advantageous embodiment, printing units 01 are arranged on both sides of the turning tower 07, i.e., in each case at least one printing unit 01 (in this case, two). In an advantageous embodiment indicated in FIG. 15 by dashed lines, the webs 02; 02' are fed to the turning tower 07 from only one side, wherein the webs 02; 02' coming from the other side are guided through below the turning tower 07, as shown, or above the turning tower 07, and wherein partial webs 02.*x*; 02.*y* can be guided through the turning tower 07 as described above, and reintroduced from there.

Figure 16:
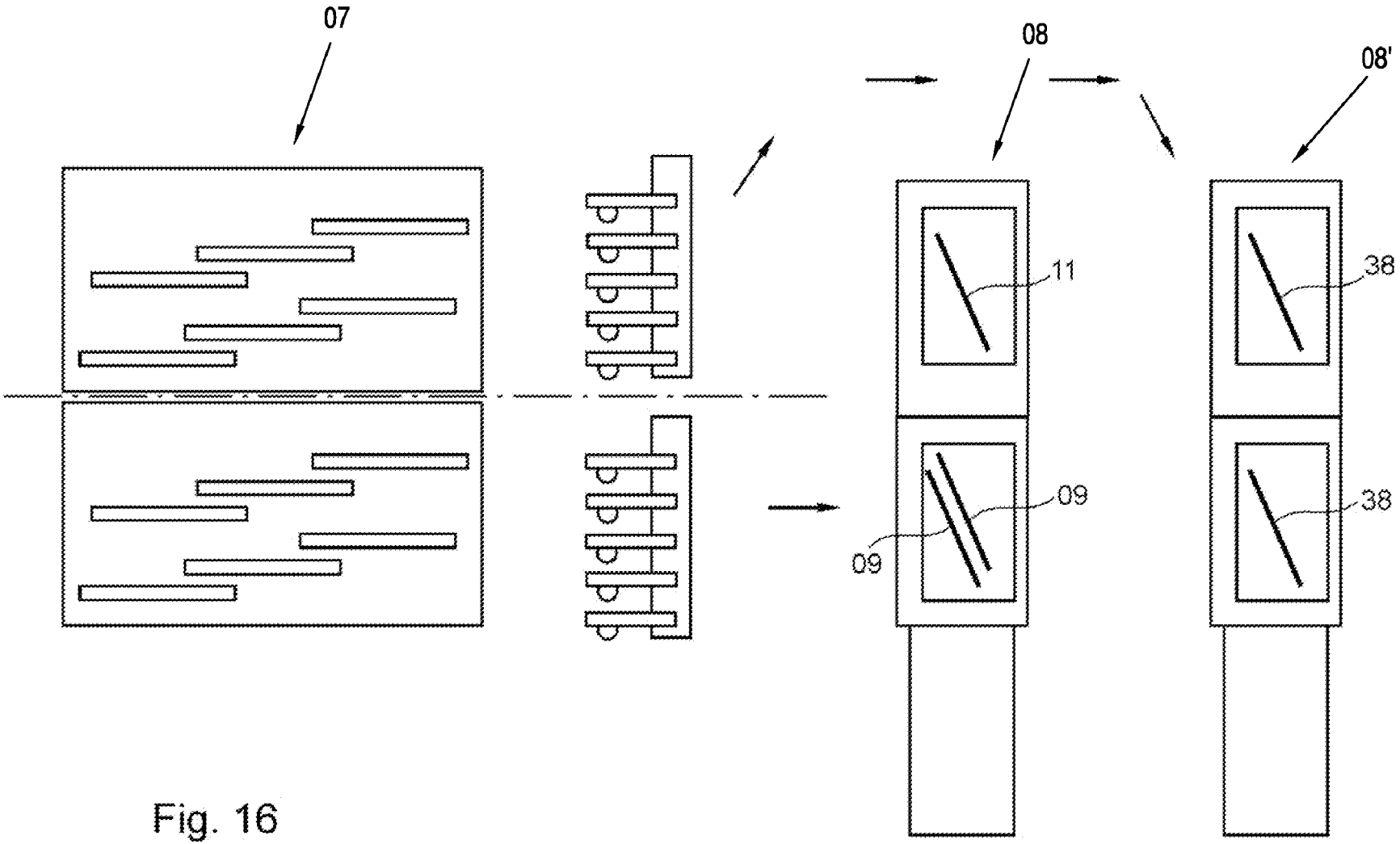
FIG. 16 a web path/production example for the printing press, with two former structures arranged one in front of the other.

FIG. 16 shows an embodiment of the printing press with two former structures 08; 08' arranged one in front of the other in the direction of web travel, as shown by way of example in FIG. 1, wherein the second former structure 08' in the direction of web travel has two planes, for example, each with only one fold former 38. The width of this fold former 38 can then preferably correspond to that of an above-described "wider" fold former 09.1 or 11. The above description relating to that fold former applies here. In this case, the turning tower 07 has one group having a number of upper turning bars 16; 17 and one group having a number of lower turning bars 16; 17, with that number corresponding to the first number, for example. The partial webs 02.*x*; 02'.y guided to the upper group are guided, for example, past the first former structure 08 to the—preferably single-width—second former structure 08'. Different products can thereby be produced simultaneously, for example, wherein on one or more left printing units 01 of the printing press (FIG. 1), for example, a product, for example, a newspaper product, is produced via one group, for example, a lower group, of turning bars 16; 17 from the first former structure 08, while at the same time, on one or more right printing units 01—for example, in heatset—production is carried out via an upper group of turning bars 16; 17 on the second former structure 08'.

If the second former structure 08' is only single-width, the upper group of turning bars 16; 17 can be equipped with only short, cantilevered turning bars 16.

Figure 17:
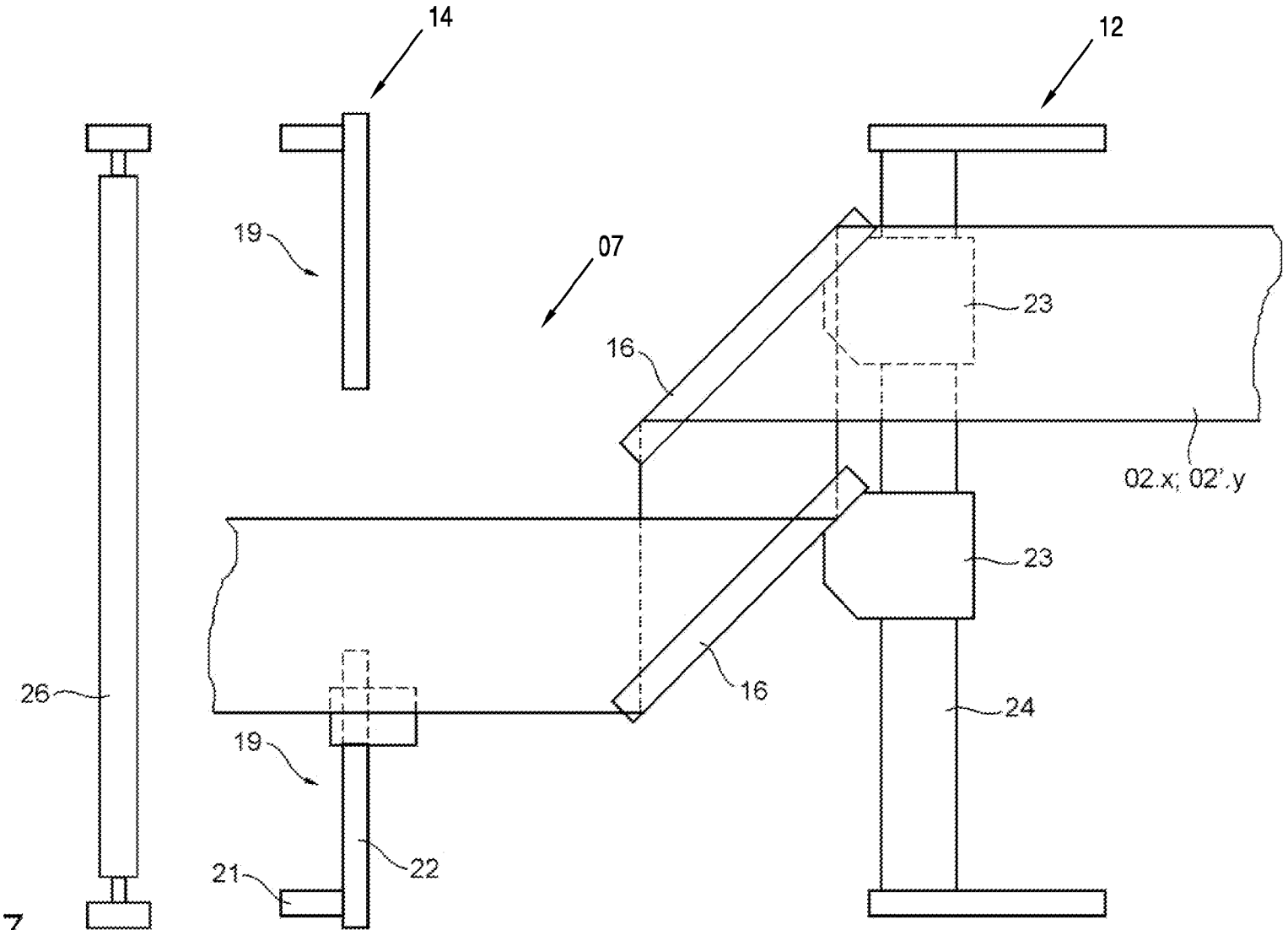
FIG. 17 an example of the offset of a partial web in the case of straight web travel.
Figure 18:
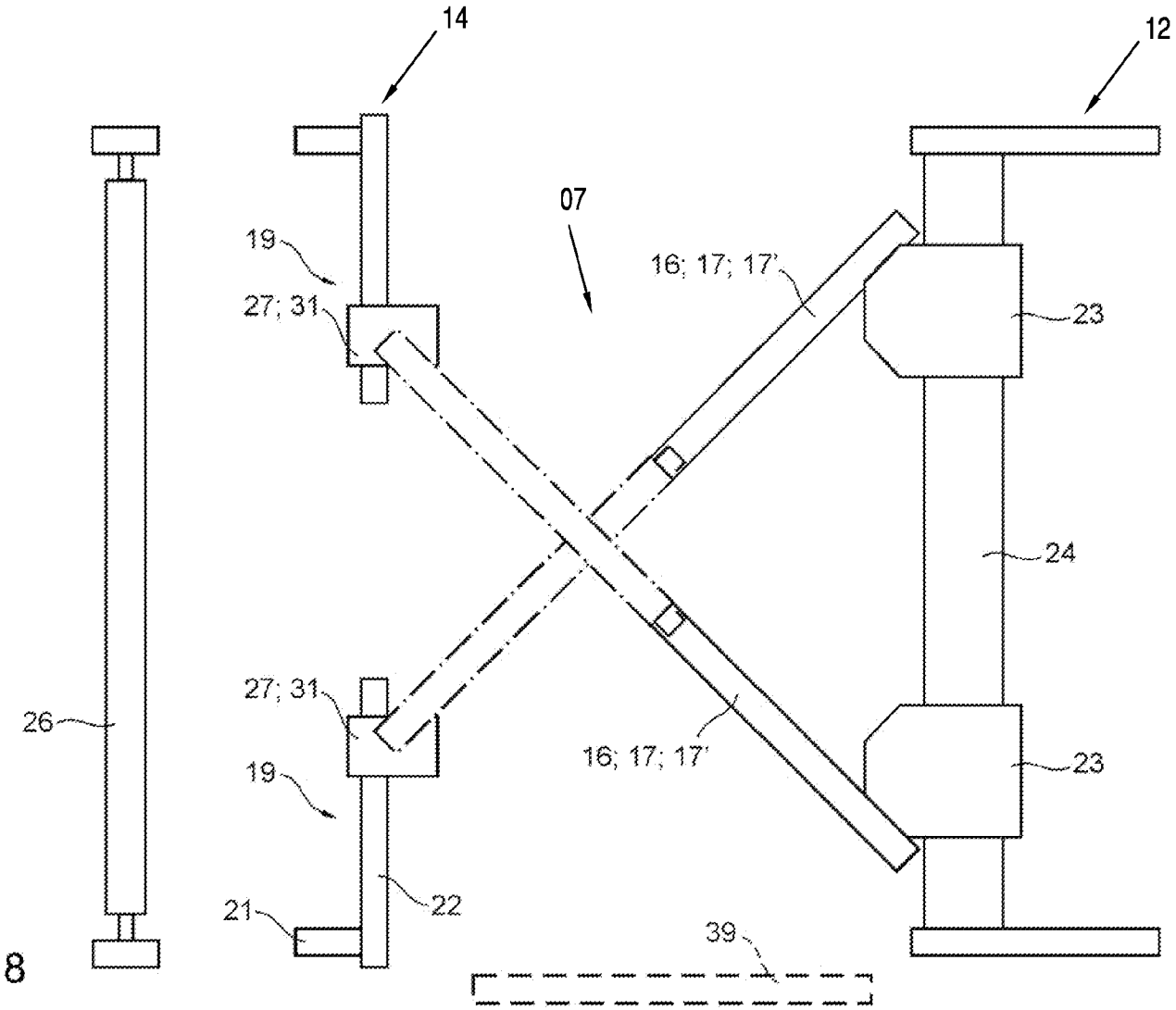
FIG. 18 an example of the arrangement of two crossed, long turning bars with straight web travel.
Figure 19:
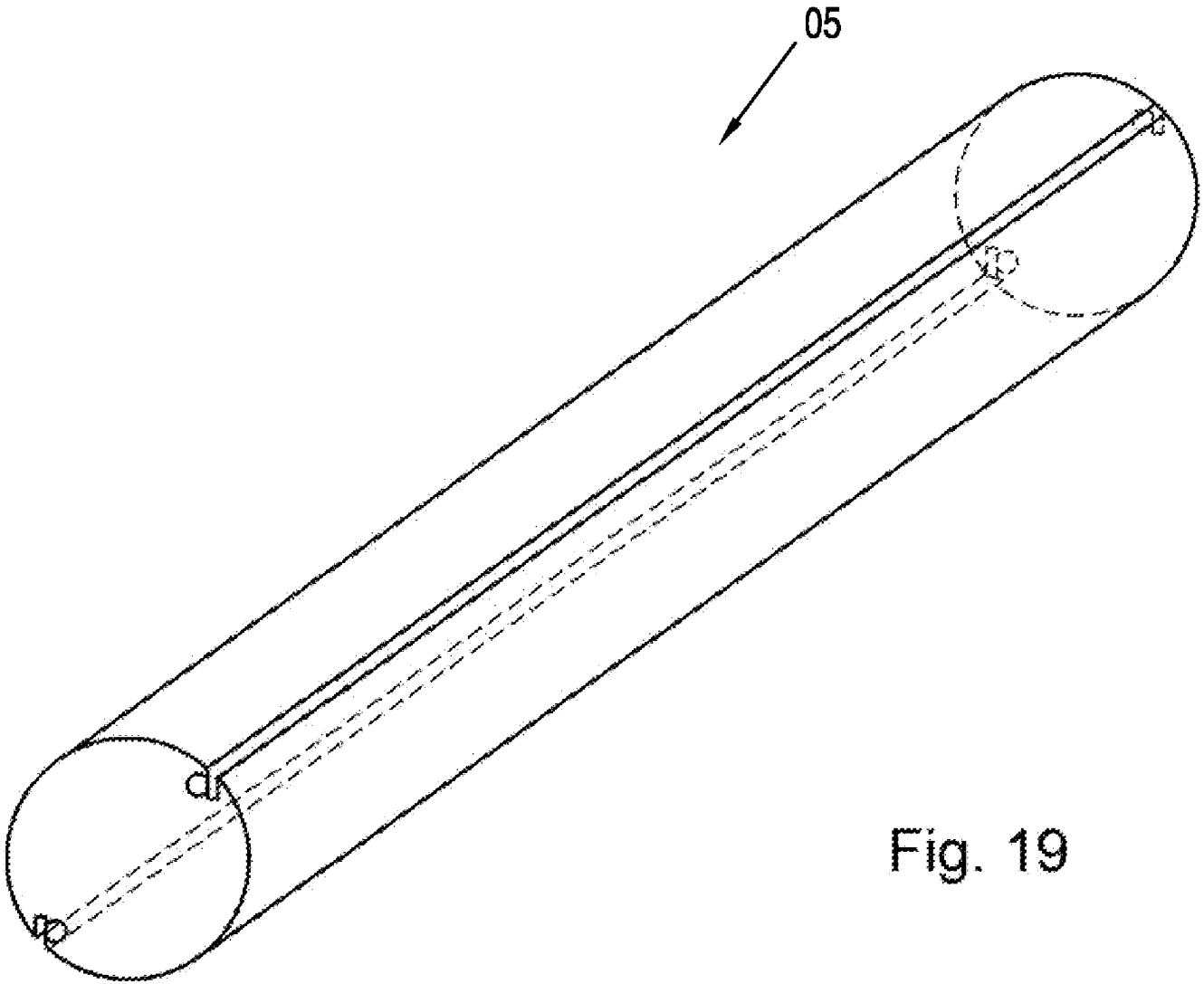
FIG. 19 a schematic illustration of a forme cylinder body with a clamping groove that is continuous over substantially the entire usable length of the cylinder.

FIGS. 17 and 18 schematically illustrate an advantageous embodiment of the turning tower 07 for the case in which the former structure 08 or former structures 08; 08' is or are not offset 90°, but is or are arranged straight along the machine alignment F. FIG. 17 illustrates an operating situation in which a partial web 02.*x*; 02'.y is offset only laterally in its alignment by passing through two parallel turning bars 16. Two short turning bars 16 of the turning tower 07 can be used for this purpose. In contrast, FIG. 18 shows two crossed, long turning bars 17, via which, for example, a full web 02; 02' or partial web 02.*x*; 02'.y that corresponds to at least one-half the maximum width b_max (e.g., three, four or more newspaper pages wide) can be dropped—for example, via a bay window path over an additional roller 39. Not shown is an operating mode having two parallel long turning bars 17, with which a web 02; 02' or partial web 02.*x*; 02'.y corresponding to at least one-half, but less than a full, maximum width b_max can be offset laterally. With regard to the mounting and supporting of the short and/or long turning bars 16; 17, the above is to be applied.

For mixed and/or hybrid production, i.e., when coldset webs 02 and heatset webs 02' will be combined, more particularly, on a fold former 09; 11, to form a combined product, an advantageous configuration for the aforementioned embodiments involves the nominal web width b (before imprinting, i.e., on the reel changer, for example) of the heatset web 02' and the coldset web deviating from one another by 0.5 to 2%, more particularly, by 1% to 1.5%, wherein the heatset web 02' is the wider of the two. This means, for example, for a "nominal" production width of 66" a nominal width b of the heatset web 02' of, for example, 66" and a smaller nominal reel width of the coldset web 02 of approximately 65.66" to 64.7", or conversely, the coldset web 02 (before imprinting) having a nominal width b of 66" and the heatset web 02 having a nominal width b (before imprinting and drying) of 66.33" to 67.32". This also applies similarly to production runs using narrower webs 02; 02' or partial-width (¾, ½-width, etc.) webs 02; 02'.

Figure 23A:
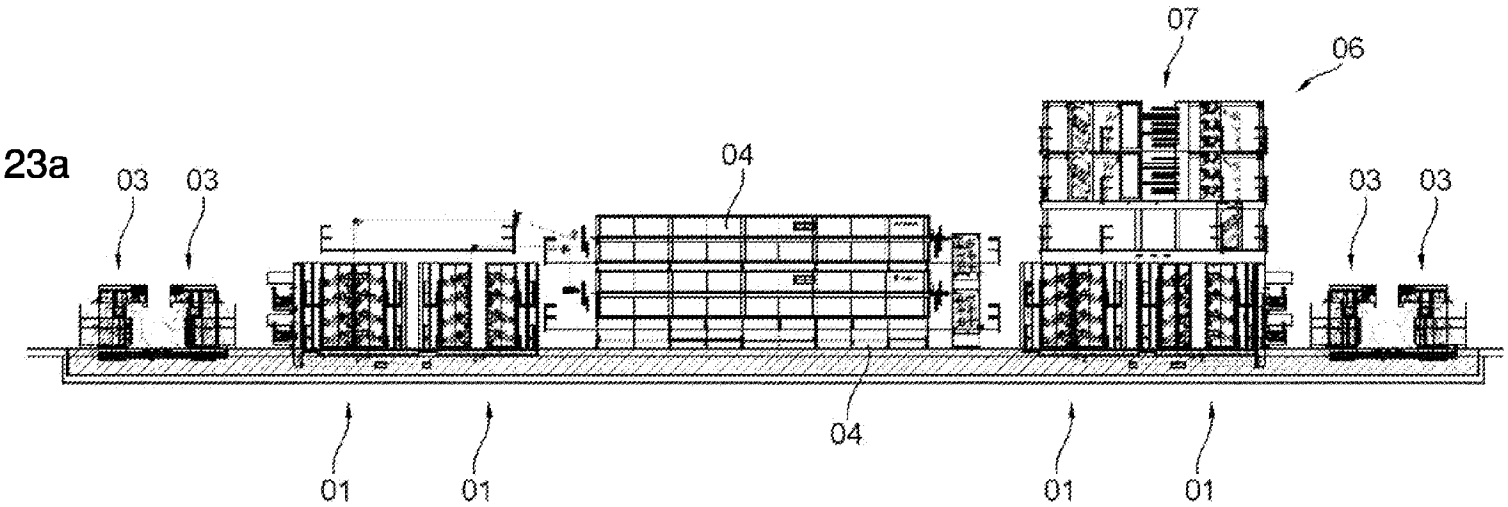
FIG. 23*a*) a side elevation view of the first variant of the printing press.
Figure 23B:
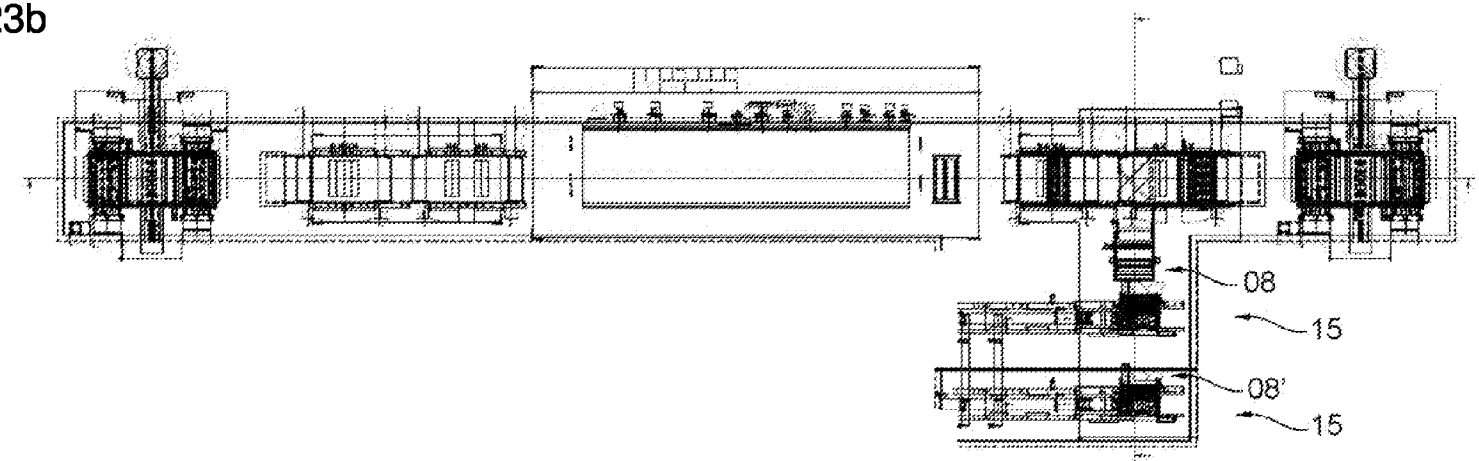
FIG. 23*b*) a top plan view of the first variant of the printing press.
Figure 24A:
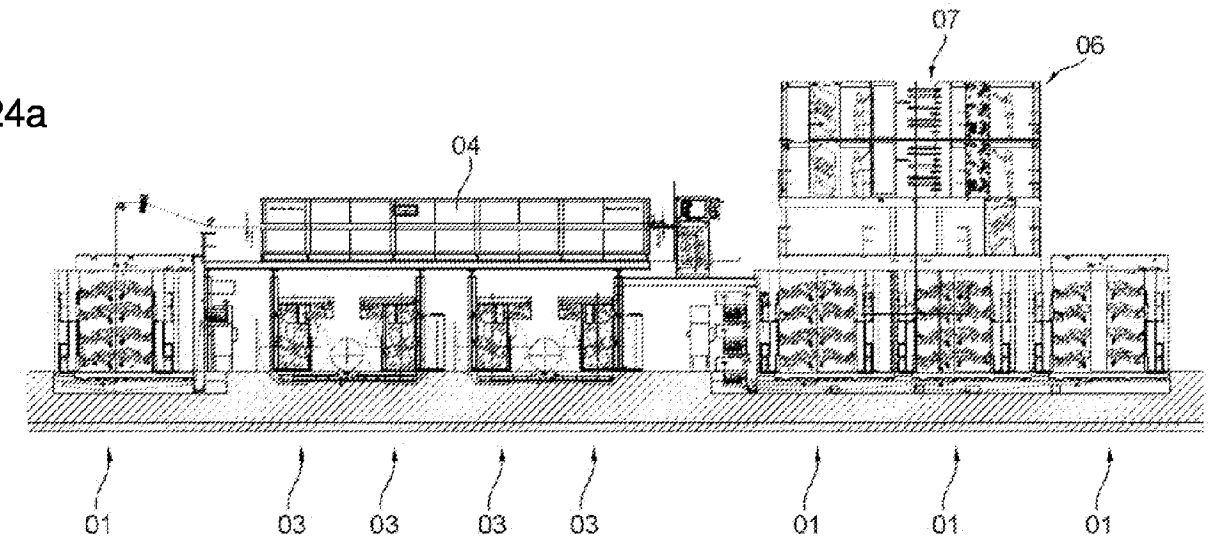
FIG. 24*a*) a side elevation view of a second variant of the printing press.
Figure 24B:
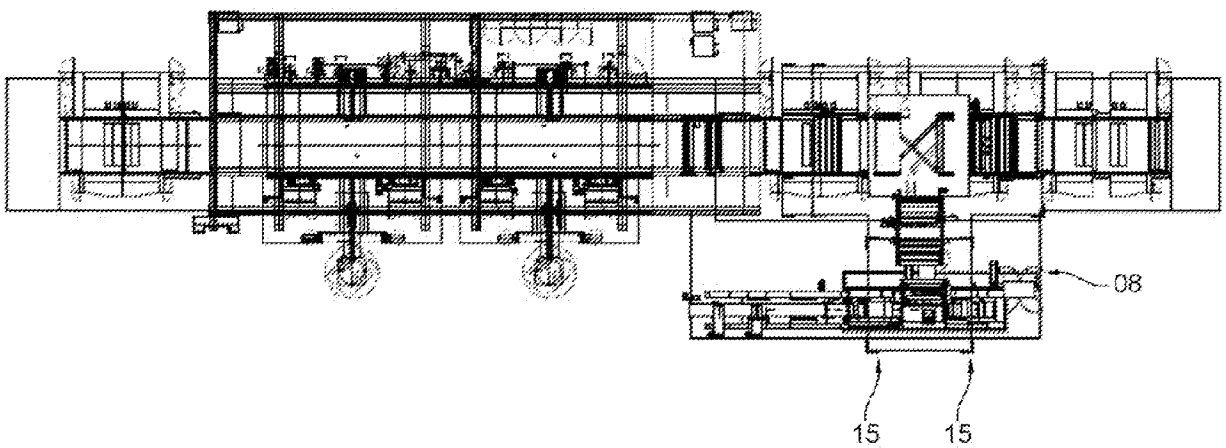
FIG. 24*b*) a top plan view of the second variant of the printing press.

FIG. 23 and FIG. 24 show variants for the printing press comprising first and second printing units, wherein in this case the superstructure, more particularly, the turning tower 07, is disposed on a frame provided above the coldset printing units 01 (additional or second printing units). In this case, although not all the second printing units are on the other side of the turning tower (from a plan view), the press is still more compact. In FIG. 23, two first printing units 01 (heatset printing units) with dryers 04 positioned in the web path, for example, one above the other, are provided, along with two second printing units 01 (coldset printing units) without dryers. In the embodiment according to FIG. 24, three second printing units 01 (without dryers) and one first printing unit 01 with a dryer 04 are provided in one web path. In FIG. 23, two former structures 08; 08', each with one folding unit 15, are provided, and in FIG. 24, one former structure 08 with two folding units 15 is provided, however, this can also be applied conversely.

While preferred embodiments of a superstructure of a printing press and a printing press and methods for using a printing press, in accordance with the present invention, have been set forth fully and completely hereinabove, it will be apparent to one of skill in the art that various changes in, for example, the specific drives for the printing units and their structures, the types of reel changers used to supply the webs, and the like, could be made without departing from the true spirit and scope of the subject invention which is to be limited only by the appended claims.

What is claimed is:

1. A printing press comprising at least one first printing unit and one turning tower disposed in a same machine alignment, and through which one turning tower one of a first web and a first partial web cut from said first web, and guided through the at least one first printing unit, can be deflected 90° out of the same machine alignment to a former structure, which former structure is aligned with the one turning tower and which former structure is aligned, in terms of a direction of web travel of one of the first web and the first partial web entering the former structure, rotated 90° from the same machine alignment, and which former structure has at least one former plane and at least first and second fold formers arranged side by side in a first former plane, wherein usable widths of the at least first and second fold formers are different from one another, and further wherein at least one of the at least first and second fold formers is embodied as being movable transversely to the direction of web travel of the one of the first web and the first partial web entering the former structure.

2. The printing press according to claim 1, wherein the at least one first printing unit includes, a dryer and with which the one of the first web and the first partial web which has passed through the first printing unit can be guided on a first web path, and further including at least one second printing unit, and the one turning tower and further wherein between the at least one second printing unit and the one turning tower there is provided a second web path without a dryer.

3. The printing press according to claim 2, characterized in that one of the first web and the first partial web cut longitudinally from the first web, and fed through the first printing unit and the dryer, and one of a second web and a second partial web cut longitudinally from this second web, and fed through the second printing unit on the second web path without a dryer, can be fed one of simultaneously and alternatively to turning bars of the one turning tower.

4. The printing press according to claim 2, characterized in that the first printing unit and the second printing unit have the same nominal width.

5. The printing press according to claim 4, characterized in that the first printing unit and second printing unit are both embodied as printing towers each having a substantially vertical web path and having a plurality of print positions arranged vertically one above the other.

6. The printing press according to claim 2 wherein, in a first operating situation, at least the one of the first web and the first partial web which has been fed through the dryer, and at least one of a second web and a partial web which has passed through the at least one second printing unit without a dryer are fed via the one turning tower and to the former structure and are combined to form a combined web bundle.

7. The printing press according to claim 2 wherein the first printing unit and the second printing unit are both embodied as triple-width.

8. The printing press according to claim 1, characterized in that at least one of the at least one first printing unit is embodied with a forme cylinder, and wherein each of which forme cylinders has at least one groove extending over an entire effective cylinder width and being intended for fastening the ends of printing formes positioned on the forme cylinder.

9. The printing press according to claim 8, characterized in that in at least one operating situation, each forme cylinder is loaded with one printing forme, which extends over more than one-half the entire effective cylinder length in a cylinder axial direction.

10. The printing press according to claim 1, further including a superstructure including the one turning tower with at least one first turning bar, having a first turning bar length and which at least one first turning bar can be used to deflect a first web ribbon 90° in its direction of first web ribbon transport, and with at least one second turning bar, having a second turning bar length which is shorter than the first turning bar length, and which at least one second turning bar can be used to deflect a second web ribbon 90° in its direction of second web ribbon transport, to the same direction as the first web ribbon, wherein the first and second turning bars are arranged in the one turning tower offset vertically from each other, wherein the first turning bar is supported at both ends on a first side frame and on a second side frame, wherein the second turning bar is supported at only one end and is cantilevered on the first side frame, and further wherein the second side frame is embodied with access into an interior of the one turning tower.

11. The printing press according to claim 1 further including first and second folding units situated downstream of the former structure.

12. The printing press according to claim 1, characterized in that the former structure has a third fold former in a second former plane, the width of third fold former extends over a center plane of an effective width of the former structure.

13. The printing press according to claim 1 further including first and second former structures arranged one in front of the other in the direction of web travel, and being situated downstream of the one turning tower.

14. The printing press according to claim 1 further including first and second folding units situated downstream of the one turning tower.

15. The printing press according to claim 1 wherein in a second operating situation, one of the two fold formers and having a larger one of the usable widths of the at least first and second fold formers is operated over an effective width which is smaller than that larger one of the usable widths of the at least first and second fold formers.

* * * * *